US011148035B2

(12) United States Patent
Shaffer et al.

(10) Patent No.: US 11,148,035 B2
(45) Date of Patent: Oct. 19, 2021

(54) BLADE TREATMENTS

(71) Applicant: Conicity Technologies, Pittsburgh, PA (US)

(72) Inventors: William R. Shaffer, Greensburg, PA (US); Lucas A. Shaffer, Pittsburgh, PA (US)

(73) Assignee: CONICITY TECHNOLOGIES, Latrobe, PA (US)

( * ) Notice: Subject to any disclaimer, the term of this patent is extended or adjusted under 35 U.S.C. 154(b) by 503 days.

(21) Appl. No.: 16/031,611

(22) Filed: Jul. 10, 2018

(65) Prior Publication Data

US 2019/0091550 A1 Mar. 28, 2019

Related U.S. Application Data

(60) Provisional application No. 62/562,288, filed on Sep. 22, 2017.

(51) Int. Cl.

| | |
|---|---|
| ***B24B 19/00*** | (2006.01) |
| ***A63C 3/10*** | (2006.01) |
| ***A63C 1/32*** | (2006.01) |

(52) U.S. Cl.

CPC . *A63C 3/10* (2013.01); *A63C 1/32* (2013.01)

(58) Field of Classification Search

CPC ..... B24B 3/003; B24B 27/0076; A63C 3/10; A63C 1/32

USPC ..... 451/45, 57, 58, 65–67

See application file for complete search history.

(56) References Cited

U.S. PATENT DOCUMENTS

| | | | | |
|---|---|---|---|---|
| 2,438,543 A * | 3/1948 | Gustin | B24B 3/003 | 451/153 |
| 2,563,018 A * | 8/1951 | Fello | B24B 3/003 | 451/241 |
| 2,907,151 A * | 10/1959 | Peterson | B21B 45/04 | 451/55 |
| 3,827,185 A | 8/1974 | Smith | | |
| 4,646,479 A * | 3/1987 | Walker | B24B 9/00 | 451/124 |
| 4,733,500 A * | 3/1988 | David | B24B 7/12 | 451/184 |
| 5,383,307 A * | 1/1995 | Anderson | B24D 15/066 | 451/545 |
| 5,547,416 A * | 8/1996 | Timms | A63C 3/10 | 451/193 |
| 5,653,628 A * | 8/1997 | Weihrauch | A46D 9/02 | 451/540 |

(Continued)

OTHER PUBLICATIONS

Canadian Examination Search Report for Appln No. 3,011,842, dated Sep. 5, 2019 (5 pages).

*Primary Examiner* — Orlando E Aviles
*Assistant Examiner* — Donna Maynard

(57) ABSTRACT

An apparatus for treating an ice skate blade is disclosed. The apparatus comprises a rotary brush, an electric motor in signal communication with the rotary brush and operably configured to rotate the bristles about a brush axis, and a receptacle dimensioned to hold the ice skate blade relative to the rotary brush. The rotary brush comprises a hub and a plurality of bristles extending radially from the hub. The apparatus can be utilized to perform a secondary (deburring) treatment to the ice skate blade after a primary (grinding) treatment.

20 Claims, 15 Drawing Sheets

(56) References Cited

U.S. PATENT DOCUMENTS 6,171,175 B1* 1/2001 Shaikh ..... B24B 37/00 451/11
6,287,177 B1* 9/2001 Shaffer ..... B24B 3/00 451/466
6,336,848 B1* 1/2002 Sato ..... B24B 29/005 15/77
6,435,951 B1* 8/2002 Ishizaka ..... B24B 3/54 451/111
6,475,072 B1* 11/2002 Canaperi ..... B24B 37/345 257/E21.23
7,556,556 B1* 7/2009 McDonald ..... B24B 5/40 15/104.095
9,114,498 B1* 8/2015 Layton, Jr. ..... B24B 49/00
9,242,330 B1* 1/2016 Layton, Jr. ..... A63C 3/10
2006/0185716 A1* 8/2006 Murozono ..... H01L 31/0508 136/250
2007/0128469 A1* 6/2007 Okada ..... C22C 29/00 428/698
2007/0243799 A1* 10/2007 Fuchs ..... B24B 21/20 451/45
2009/0191798 A1* 7/2009 Koh ..... A46B 1/00 451/59
2011/0169233 A1* 7/2011 Wilson ..... A63C 1/30 280/11.18
2012/0108151 A1* 5/2012 Swist ..... A63C 1/32 451/45
2015/0017878 A1* 1/2015 Luechinger ..... H01L 31/18 451/1
2015/0140902 A1* 5/2015 Eriksson ..... B24B 9/04 451/28
2015/0165584 A1 6/2015 Ishikawa et al.
2016/0114464 A1* 4/2016 Layton, Jr. ..... B24D 5/10 451/488
2016/0128461 A1* 5/2016 Akashi ..... B24D 13/14 134/6
2017/0014968 A1* 1/2017 Palmieri ..... C23C 4/18
2017/0355056 A1* 12/2017 Layton, Jr. ..... A63C 1/42

* cited by examiner

BLADE TREATMENTS

CROSS-REFERENCE TO RELATED APPLICATION

This application claims the benefit of priority under 35 U.S.C. 119(e) to U.S. Provisional Patent Application Ser. No. 62/562,288, titled SYSTEM AND METHOD FOR BLADE SHARPENING, filed Sep. 22, 2017, the disclosure of which is herein incorporated by reference in its entirety.

BACKGROUND

The present disclosure relates to systems and methods for treating ice skate blades. Ice skate blades are employed in various recreational and professional sports, including hockey, figure skating, and speed skating, for example. During use, the ice skate blades can wear and/or become damaged. Treating such blades may restore the worn and/or damaged surfaces and/or edges thereof. For example, the blades can be sharpened with a grinding treatment in which portions of the blades are removed and/or reshaped.

SUMMARY

In one general aspect, an apparatus for treating an ice skate blade is disclosed. The apparatus can comprise a rotary brush, an electric motor, and a receptacle dimensioned to position the ice skate blade relative to the rotary brush. The rotary brush can comprise a hub, wherein a brush axis extends through the hub. The rotary brush can further comprise a plurality of bristles extending radially from the hub. The electric motor can be drivingly coupled to the rotary brush and operably configured to rotate the bristles about the brush axis.

A method for treating an ice skate blade is disclosed. The method can comprise positioning an ice skate in a receptacle comprising a longitudinal slot, wherein the ice skate comprises a blade, and wherein at least a portion of the blade extends through the longitudinal slot. The method can further comprise moving a rotary brush along a longitudinal path that is parallel to the longitudinal slot, wherein the rotary brush comprises a plurality of radially-extending flexible bristles configured to operably contact the blade as the rotary brush moves along the longitudinal path.

A method for sharpening ice skate blades is disclosed. The method comprises performing a primary treatment using a grinding wheel and performing a secondary treatment using an abrasive filament brush comprising flexible bristles.

BRIEF DESCRIPTION OF THE FIGURES

The features of various aspects are set forth with particularity in the appended claims. The various aspects, however, both as to organization and methods of operation, together with further objects and advantages thereof, may best be understood by reference to the following description, taken in conjunction with the accompanying drawings as follows:

DETAILED DESCRIPTION

Figure 2:
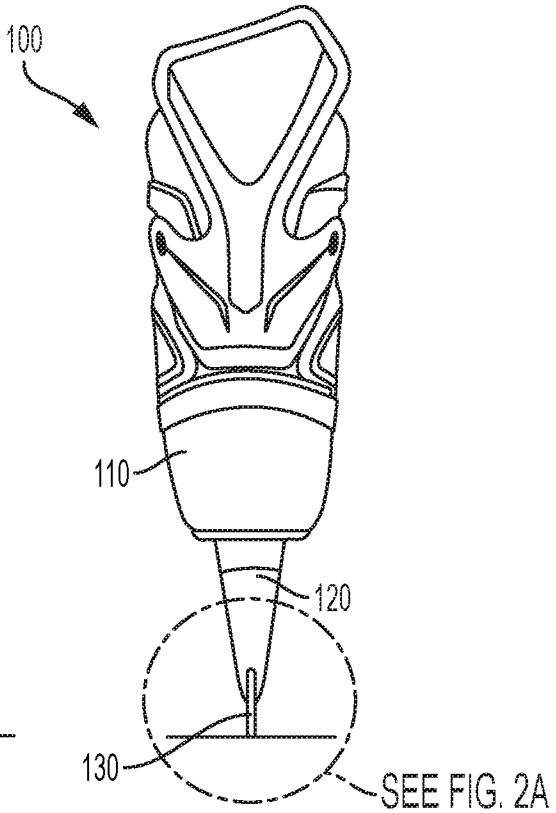
FIG. 2 is a back view of the ice skate of FIG. 1, in accordance with at least one aspect of the present disclosure.

Before explaining various aspects of blade treatments in detail, it should be noted that the illustrative examples are not limited in application or use to the details of construction and arrangement of parts illustrated in the accompanying drawings and description. The illustrative examples may be implemented or incorporated in other aspects, variations, and modifications, and may be practiced or carried out in various ways. Further, unless otherwise indicated, the terms and expressions employed herein have been chosen for the purpose of describing the illustrative examples for the convenience of the reader and are not for the purpose of limitation thereof. Also, it will be appreciated that one or more of the following-described aspects, expressions of aspects, and/or examples, can be combined with any one or more of the other following-described aspects, expressions of aspects and/or examples.

In various recreational and professional sports involving ice skating, such as hockey, figure skating, and speed skating, for example, the performance of the skater can depend on the quality of the skater's blades, in addition to the skater's physical skills, talent, experience, and coordination, for example. The blade(s) are attached to the skater's feet via shoes or boots. In general terms, a sharp blade allows the skater to move and/or glide freely over the ice. In the process of ice skating, however, a sharpened blade can become worn or damaged and may need to be re-sharpened. For example, normal abrasion between the ice and the blade and/or abnormal abrasion caused when the blade contacts a surface other than ice, such as cement or metal, for example, can wear and/or damage the edges and/or faces of the blade. As a result, the blade may need to be treated. For example, in a grinding treatment, the blade can be ground and/or resurfaced to restore the appropriate contour to the face and hollow of the blade and/or to restore sharpness to the edges (also referred to as the "corners") of the blade. Such a grinding treatment can be considered sharpening or re-sharpening of the ice skate blade.

The functionality and overall performance of the blade depends on the blade being properly ground and/or resurfaced during a grinding treatment. In certain instances, the blade can be ground to have sharp edges on each side thereof. A hollow can be defined between the edges of the blade. The blade can be ground to have a smooth surface on the hollow in order to minimize drag and friction and, thus, increase the skater's speed. Hollows can have different configurations, as further described herein. Moreover, the sharp edges are configured to provide sufficient friction between the blade and the ice for full and precise maneuverability when starting, stopping, and turning, for example. Sharp edges provide an increased degree of friction between the skate and the ice at a specific location, i.e., along the length of the edges of the blade, such that the skater can maintain maximum control. Sharp edges also provide the skater with an ability to gain increased speed by pushing off the edges of the skates.

Figure 1:
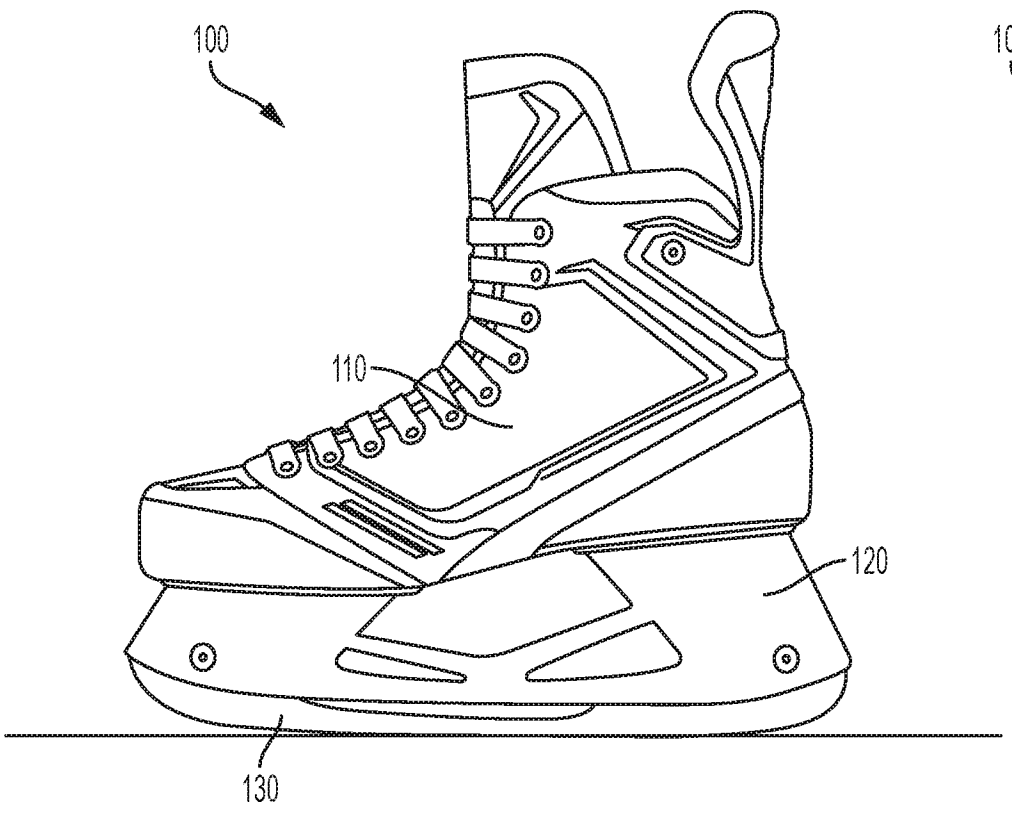
FIG. 1 is a side elevation view of an ice skate including a blade, in accordance with at least one aspect of the present disclosure.
Figure 2A:
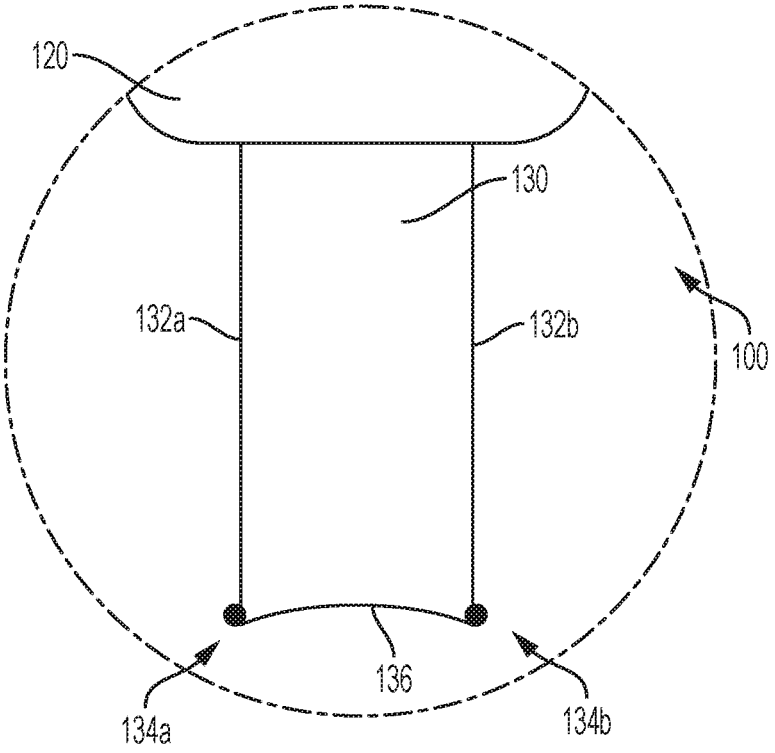
FIG. 2A is a detail view of a portion of FIG. 2, in accordance with at least one aspect of the present disclosure.

An ice skate 100 is shown in FIGS. 1, 2, and 2A. The ice skate 100 includes a boot 110, a chassis 120 extending downwardly from the boot 110, and a blade 130 extending downwardly from the chassis 120. Referring now to FIG. 2A, the blade 130 comprises two opposing faces 132*a* and 132*b*, two edges 134*a* and 134*b*, and a hollow 136. More specifically, the edges 134*a*, 134*b* are located at the point where the faces 132*a*, 132*b* meet the hollow 136. As described herein, the hollow 136 is ground into the bottom of the blade 130 using a grinding wheel. Different grinding wheel configurations can be used to create different hollow geometries in the bottom of the blade, as further described herein.

Figure 3:
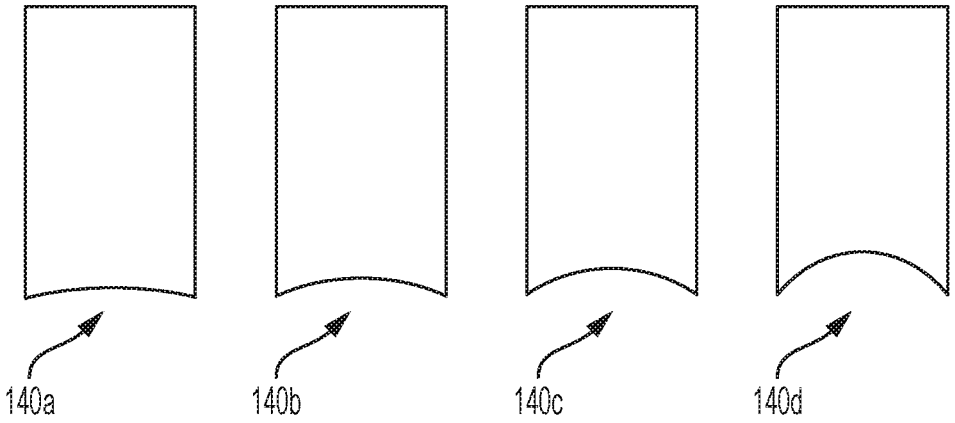
FIG. 3 is a schematic of various radius hollows for an ice skate blade, in accordance with at least one aspect of the present disclosure.
Figure 4:
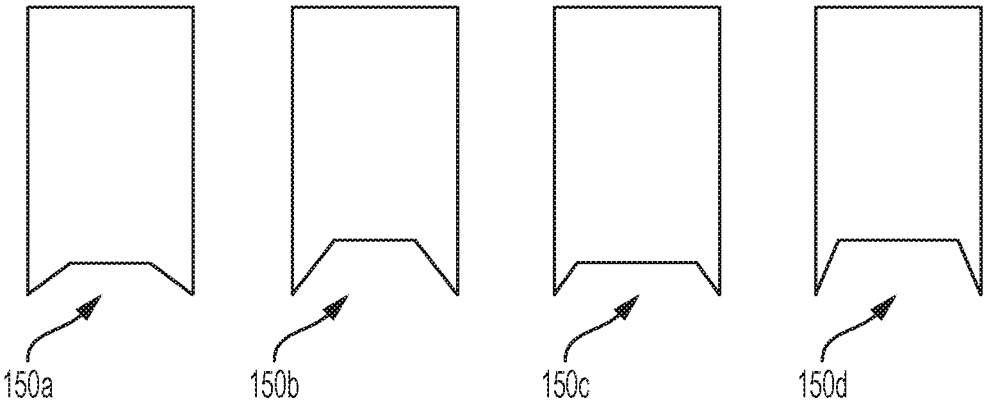
FIG. 4 is a schematic of various flat-bottomed "V" hollows for an ice skate blade, in accordance with at least one aspect of the present disclosure.

Turning now to FIGS. 3 and 4, various configurations of blade hollows are shown. More specifically, FIG. 3 depicts radius hollows and FIG. 4 depicts flat-bottomed "V" hollows. The radius hollows (FIG. 3) are created using a grinding wheel with a rounded edge radius; therefore, the hollow formed in the skate blade is rounded. The flat-bottomed "V" hollows (FIG. 4) are created using a grinding wheel with a flat surface around the perimeter and two angled sides extending radially inward from the flat surface, which imparts a hollow with a flat portion at the top of the hollow (e.g., the flat bottom) and two angled sides at the edges. The performance characteristics of the blade can depend on the geometry of the hollow, as further described herein.

FIG. 3 depicts a 1-inch (25.4 mm) radius hollow 140*a*, a ⅝-inch (15.875 mm) radius hollow 140*b*, a ½-inch (12.7 mm) radius hollow 140*c*, and a ⅜-inch (9.525 mm) radius hollow 140*d*, for example. As can be seen in FIG. 3, a small hollow radius, such as the ⅜-inch (9.525 mm) radius hollow 140*d*, typically has larger edges. Larger edges can generate increased drag and/or friction and, thus, less glide with respect to the ice. A large hollow radius, such as the 1-inch (25.4 mm) radius hollow 140*a*, typically has smaller edges. Smaller edges can result in less drag and/or friction and, thus, more glide with respect to the ice.

FIG. 4 depicts a 90/50 flat-bottomed "V" hollow 150*a*, a 90/75 flat-bottomed "V" hollow 150*b*, a 100/50 flat-bottomed "V" hollow 150*c*, and a 100/75 flat-bottomed "V" hollow 150*d*. The flat-bottomed "V" hollows are described by two dimensions corresponding to the width and depth of the hollow. More specifically, the first number of the hollow size is the width of the flat bottom portion, and the second number is the edge depth (e.g., the distance from the flat bottom to the tip of the edges). For example, the 90/50 flat-bottomed "V" hollow 150*a* has a flat-bottom width of 90 millimeters and an edge depth of 50 millimeters.

Similar to the radius grinding process, the flat-bottomed "V" grinding process can produce smaller or larger edges depending on the configuration of the grinding wheel used in the grinding process. Further, the shape of the grinding wheel used for a flat-bottomed "V" hollow will also affect the width of the flat-bottomed portion of the hollow. For example, as can be seen in FIG. 4, larger edges and a large flat bottom are present in the 100/75 flat-bottomed "V" hollow 150*d*, which may result in more drag and/or friction and, thus, less glide with respect to the ice. Further, smaller edges and a small flat bottom are present in the 90/50 flat-bottom-"V" hollow 150*a*, which may result in less drag and/or friction and, thus, more glide with respect to the ice. Accordingly, the flat-bottomed "V" grinding process may allow the size of the edges and the distance between the top of the hollow and the end of the edges to be independent of one another. Conversely, when sharpening with a radius hollow grinding wheel, the size of the edges is typically directly dependent on the radius of the grinding wheel edge.

Typically, the blades are comprised of steel or a steel alloy. To extend the usable life and/or enhance the performance of the blade, the blade is often comprised of heat-treated hardened steel, for example. Due to the inherent wear-resistance of a heat-treated hardened steel blade, the blade can require specialized grinding equipment. For example, grinding wheels can be used in the grinding and/or resurfacing process. The grinding and resurfacing process is typically accomplished by manually manipulating a blade relative to the grinding wheel. As such, the grinding process can accommodate a multitude of individual preferences with respect to the desired blade shape and grind. A grinding wheel is typically comprised of 80 grit fused Aluminum (e.g. 80 grit Alundum®) or Aluminum Oxide.

Figure 5:
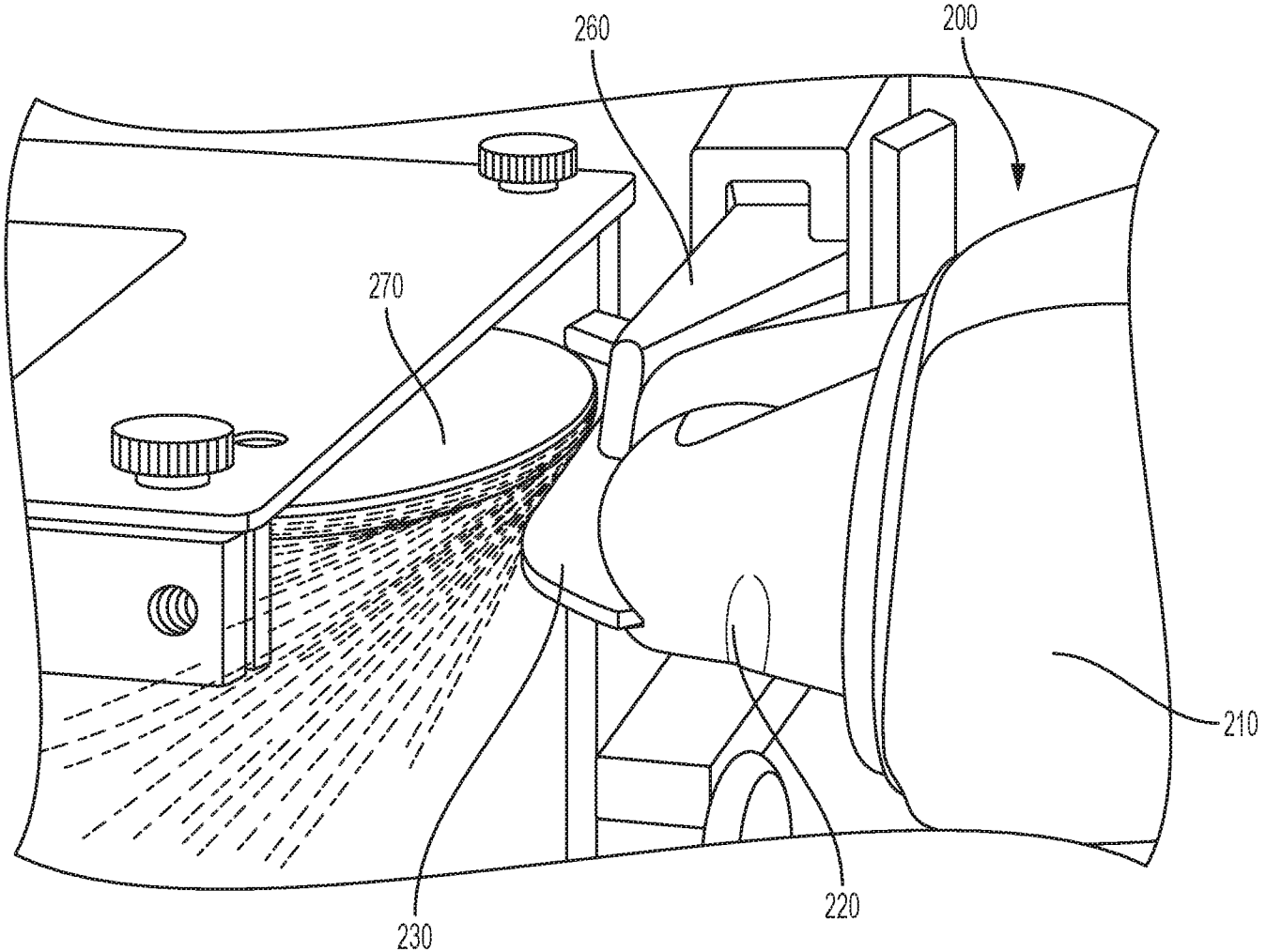
FIG. 5 is a perspective view of a grinding wheel and an ice skate including a blade, depicting the grinding wheel being used to sharpen the blade, in accordance with at least one aspect of the present disclosure.

FIG. 5 depicts an ice skate 200 including a boot 210, a chassis 220 extending downwardly from the boot 210, and a blade 230 extending downwardly from the chassis 220. The ice skate 200 is similar in many respects to the ice skate 100. In FIG. 5, the ice skate 200 is setup to undergo a sharpening treatment with a typical grinding wheel 270. In the grinding treatment, the blade 230 is mounted in a fixture 260 for holding the blade 230 (and for holding the boot 210 if the blade 230 is sharpened when it is attached to the boot 210). The fixture 260 is configured to hold the blade 230 in a level position that is essentially centered and parallel with respect to the grinding wheel 270, for example. The blade 230 can then be moved by hand such that the blade is positioned in contact with the grinding wheel 270, as depicted in FIG. 5. In such instances, the grinding process is controlled by the operator's hand pressure and movement. Such a grinding process requires a specific skill set and experience to achieve effective results. Although there is a basic set of flexible rules or guidelines that can be followed to grind blades, blade grinding is often considered an art or skill that relies upon personal experience and expertise to achieve the best results.

Figure 6:
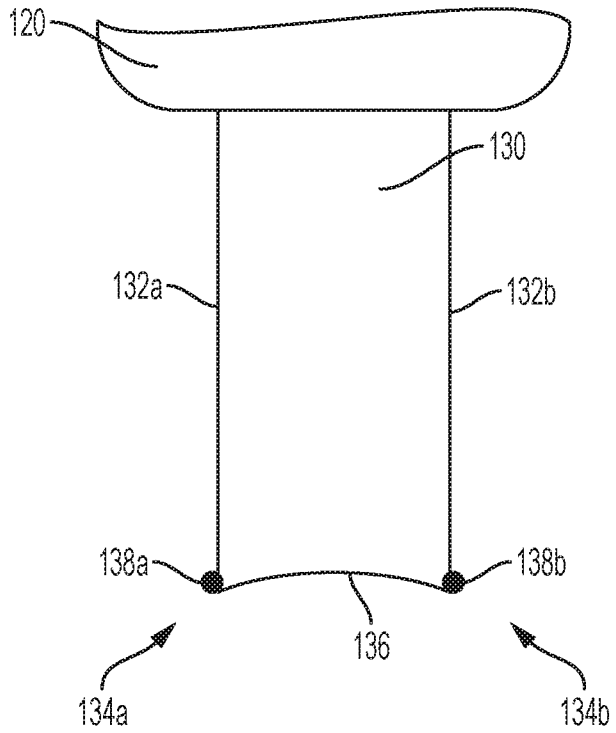
FIG. 6 is an end view of the blade of FIG. 1, depicting burrs on the edges of the blade, in accordance with at least one aspect of the present disclosure.

During the grinding treatment, material is removed from the blade, which causes heat and pressure to develop in the blade. The combination of heat and pressure during grinding can result in the edges 134*a*, 134*b* of the blade 130 and/or the faces 132*a*, 132*b* of the blade 130 developing grinding flaws or defects, such as burrs. Turning now to FIG. 6, burrs 138*a* and 138*b* are shown on the edges 134*a*, 134*b* of the blade 130. As the hollow 136 is ground, material is displaced from the hollow 136 outwardly towards the edges 134*a*, 134*b* to create the burrs 138*a*, 138*b*. Other grinding defects can also arise during the grinding treatment. The burrs 138*a*, 138*b* and/or other grinding defects in the blade 130 can be small in size. For example, the burrs 138*a*, 138*b* may be invisible to the naked eye. In certain instances, operator expertise and experience may minimize the effects of grinding, i.e. minimize or reduce the development of burrs and/or other defects; however, even an experienced operator cannot produce a blade that is entirely burr-free or defect-free. In certain instances, grinding of the ice skate blade can also produce an undesirable surface issue known as "chatter".

As further described herein, although a grinding treatment can improve a worn and/or damaged blade, the grinding treatment can also generate grinding flaws on the blade, which can negatively impact the performance thereof. For example, a grinding flaw on the hollow can increase friction between the hollow and the ice. Additionally, a grinding flaw on the edges can increase the likelihood that the blade will catch or snag on the ice, which can negatively impact the skater's maneuverability and balance, for example.

In various instances, the removal of grinding defects enhances the performance of the blade. For example, by reducing the friction between the hollow of the blade and the ice, skating may require less effort and, thus, may put less stress on the body of the athlete. By reducing stress on the athlete's body, incidences of leg and back problems associated with aggressive skating may be reduced. Furthermore, removing burrs and/or edge defects can decreases the chance that these defects will cause the skater to fall unexpectedly. More specifically, edge defects and/or burrs can snag or engage ruts or imperfections in the ice in a manner that the skater does not expect and, thus, cause the skater to fall.

Additionally, in certain instances, the grinding defects, such as the burrs 138*a* and 138*b*, for example, can be very thin and/or sharp. Such flaws are often referred to as "razor-sharp" and, in certain instances, may lacerate a material (e.g. skin, clothing, etc.) that is brought into contact with the flaw. In other words, the existence of razor-sharp flaws on a blade can increase the likelihood of lacerations by the blade. When such flaws are removed, more pressure may need to be applied to lacerate the material. For example, if the surface defects (e.g. razor-sharp burrs) are removed from the blade, the likelihood of being cut and/or the severity of the injury by the blade may be reduced. In other words, there can be a safety benefit to removing razor-sharp defects from a blade.

Because grinding defects (e.g. burrs, edge flaws, and chatter) are an unintentional and undesirable product of the grinding treatment, the removal of grinding defects is often desired. However, it is difficult to deburr and/or hone the surface of the blade to remove the grinding defects while preserving the sharp edges and desired hollow geometry.

Figure 7:
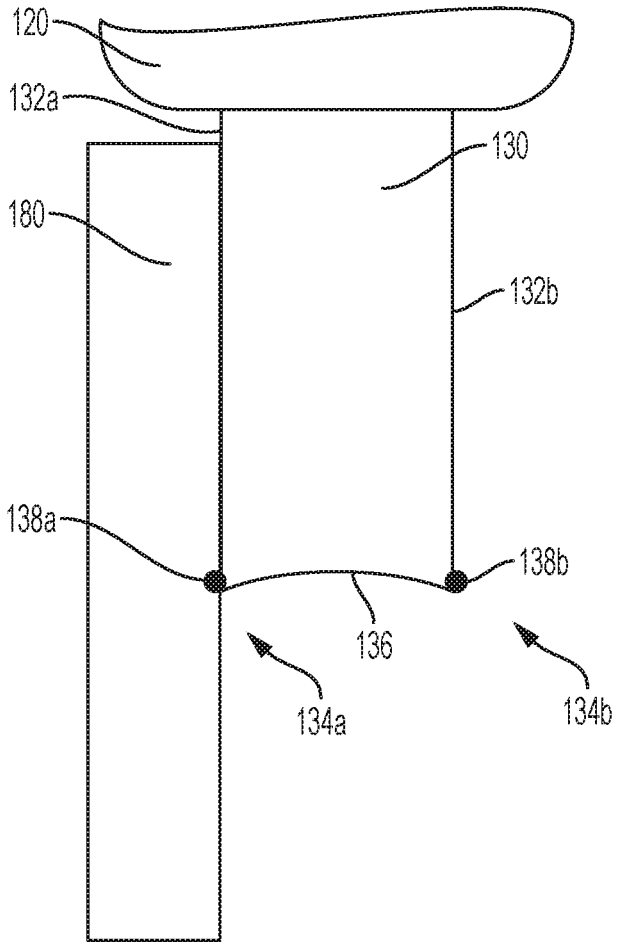
FIG. 7 is an end view of the blade of FIG. 1, and further depicts a handheld stone being used to apply a secondary treatment to the blade, in accordance with at least one aspect of the present disclosure.

In certain instances, burr removal after a grinding treatment can involve a secondary treatment. The secondary treatment can also be referred to as "deburring", "microdeburring", "honing", "regrinding", or "reconditioning", for example. In one instance, a handheld grinding stone can be employed in the secondary treatment. The handheld grinding stone is typically constructed of the same material as the grinding wheel that was used for grinding the blade. For example, the grinding stone can be comprised of 80 grit fused Aluminum (e.g. 80 grit Alundum®) or Aluminum Oxide. Referring now to FIG. 7, in one example, a grinding stone 180 can be held in one hand and positioned flush with one of the faces 132*a*, 132*b* of the blade 130. The grinding stone 180 can then be moved back and forth along the full length of the blade 130 in a stroking motion for multiple passes. The intent of such a secondary treatment (which can be referred to as a "stoning" treatment) is to remove grinding burrs or edge distortions, such as the burrs 138*a*, 138*b* for example, and to level the faces 132*a*, 132*b* of the blade 130.

The effectiveness of a secondary treatment utilizing a hand "stoning" process is limited. For example, in removing the burrs 138*a*, 138*b* and grinding flaws, the finished faces 132*a*, 132*b* of the blade 130 should be kept straight and the edges 134*a*, 134*b* of the blade 130 should be kept sharp. Moreover, the handheld grinding stone 180 cannot be used on the hollow 136 of the blade 130, nor can it be used in a cross-wise or diagonal movement across the edges 134*a*, 134*b* of the blade 130 to remove the burrs 138*a*, 138*b*. Such abrasive actions applied to the hollow 136 or to the edges 134*a*, 134*b* of the blade 130 would be detrimental to the integrity of the blade 130.

Due to the limitations surrounding the hand "stoning" treatment for burr and defect removal, the Applicants of the Subject Application have found that the secondary hand "stoning" treatment does not sufficiently remove, or even reduce to any measurable degree, the flaws developed along the faces 132*a*, 132*b* and edges 134*a*, 134*b* of the blade 130 during the grinding treatment. It is estimated that the hand "stoning" treatment may remove as little as 10% of burrs and other grinding defects from a blade. Additionally, in certain instances, the pressure of the secondary "stoning" treatment along the length of the blade can tend to deform or bend the remaining unwanted edge flaws away from the handheld grinding stone. Essentially, instead of removing the edge defects, the hand "stoning" process can bend and/or deform the edge defects toward the hollow of the blade. In such instances, the flaws are moved into a position that is in direct line with the edges of the blade, and from the skater's prospective, positioned directly under the edges and/or hollow of the blade. The condition of having the grinding burrs and/or edge distortion bent back on the ground surface, or hollow, of the blade inhibits the intended function of the blade by significantly increasing surface friction and drag between the blade and ice.

As described herein, in a grinding operation, the resultant sharpened blade can include unwanted grinding flaws. The flaws include grinding burrs, distorted corners caused by edge deformation created by heat and pressure, and grinding chatter on the ground surface, for example. These defects can produce excessive undesirable friction or drag between the blade and the ice, which reduces the effectiveness of the blade and, thus, detracts from the performance of the skater. For example, edge distortion, grinding burrs, and surface chatter have been identified as a primary cause of drag and friction between the blade and the ice. Moreover, existing secondary treatments to remove the burrs and grinding defects, such as a secondary "stoning" treatment disclosed herein, are generally ineffective.

In view of the foregoing, the reader will appreciate that the performance of the blade can be enhanced by providing a blade with a hollow and faces that are smooth and with edges that are sharp and have minimum grinding defects. Therefore, it is desirable to remove defects in the blade, produced during a grinding operation or otherwise, while maintaining the desired geometry of the blade. Additionally, deburring, removing grinding flaws, and generally smoothing the hollow on a blade can increase the corner strength, or edge strength, of the blade. Removing grinding flaws and deburring can also significantly lower the amount of undesirable friction and drag resulting from the grinding operation. Grinding chatter can also be reduced. However, currently-available secondary treatments are largely ineffective at removing and/or limiting these flaws, as described above. Moreover, certain secondary treatments (e.g., a hand held grinding stone) can deform a flaw into the hollow of the blade and, thus, be detrimental to the integrity of the hollow and edges.

In various instances, a treatment system can utilize a rotary brush, which can rotate relative to the surface of the blade to remove burrs and/or flaws. For example, a rotary brush can be utilized to de-burr the blade, remove the grinding flaws, and smooth the hollow of the blade. The rotary brush utilized in the secondary treatment can be a flexible, abrasive filament brush, for example. The bristles, or filament, of the rotary brush can be constructed of silicon carbide, diamond, and/or aluminum oxide, for example. In other instances, the rotary brush can be comprised of a suitable material(s) blended with an extruded filament, which can facilitate burr and defect removal and/or hone the blade. The filament can have the abrasive media extruded in the filament, or the abrasive media can be applied or coated on the exterior of the filament bristles. In certain instances, the rotary brushes may be brushes manufactured by Weiler Corporation of Cresco, Pa. (originally developed for Conicity Technologies of Latrobe, Pa. by Weiler Corporation), for example. Various exemplary brushes are further described herein. A secondary treatment utilizing a rotary brush, as described herein, can be referred to as a secondary brushing treatment, for example.

The treatment system can also include a motor, such as a stepper motor, for example, that is programmable such that the brush speed can be controllable and/or programmable. In certain instances, the brush can be rotated clockwise and/or counterclockwise by the motor. Additionally, the treatment system can include a linear actuator that is programmed to move the rotating brush, and motor thereof, in a forward and reverse direction, applying a stroking, or back and forth, motion to the rotary brush. The speed of the stroking motion and the number of strokes made during a deburring/defect-removal cycle can be programmable. For example, a preset program can be stored in the memory of the system and can be configured to treat blades having a wide range of different hollow geometries and/or degrees of wear. In various instances, the treatment system can further include a protective housing that contains and covers the moving parts of the system. In one aspect, a treatment system can also include a clamp or holding station for securing the blade during the secondary treatment.

Figure 8:
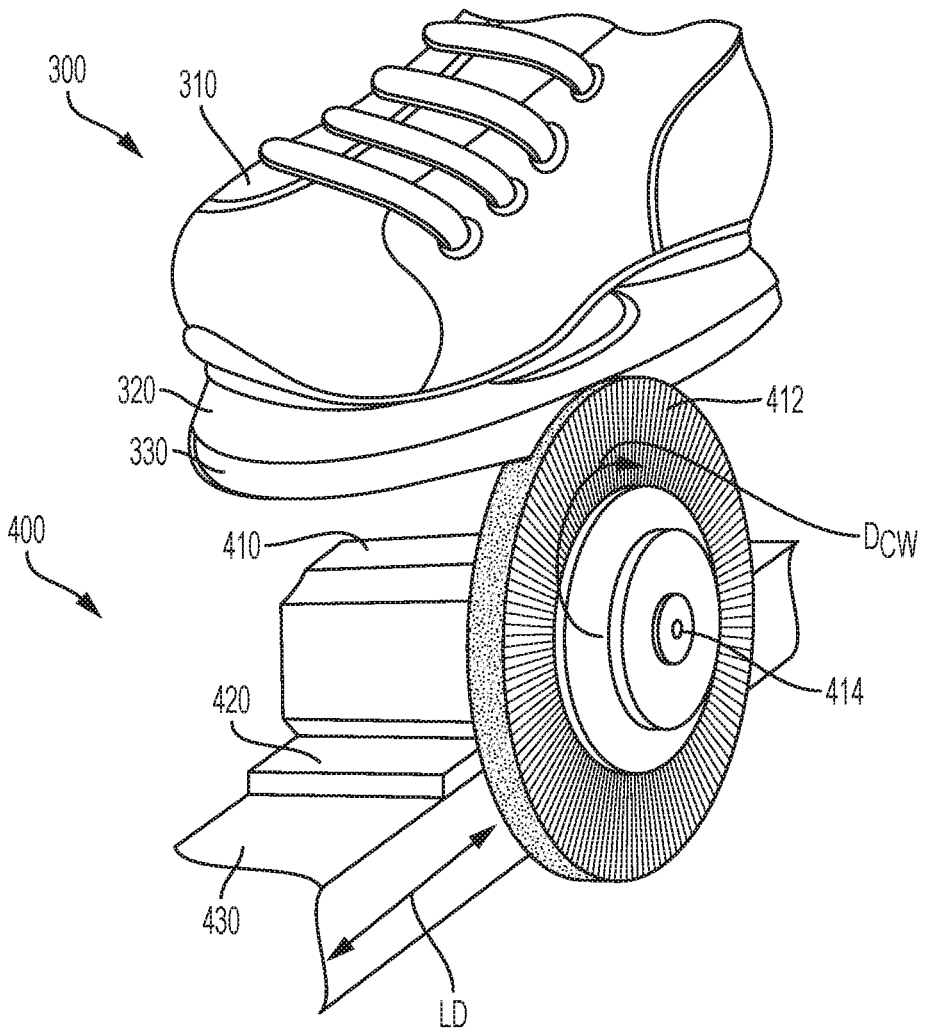
FIG. 8 is a perspective view of a portion of an ice skate and a secondary treatment system including a rotary brush, depicting the rotary brush in contact with a blade of the ice skate during a secondary treatment, in accordance with at least one aspect of the present disclosure.
Figure 9:
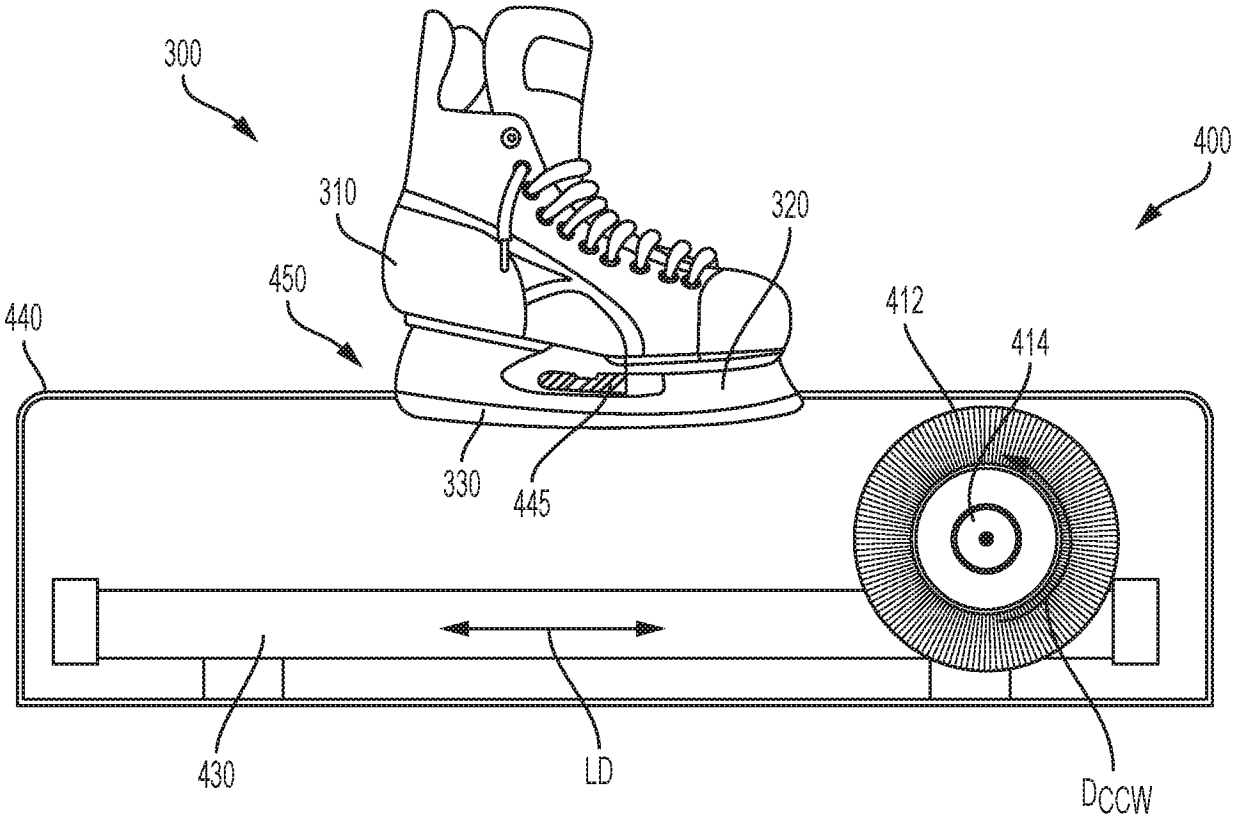
FIG. 9 is a side elevation view of the treatment system and the ice skate of FIG. 8 with certain portions of a housing of the treatment system removed for clarity, depicting the rotary brush positioned out of contact with the blade of the ice skate, in accordance with at least one aspect of the present disclosure.

FIGS. 8 and 9 depict a treatment system 400 for removing edge and surface defects from an ice skate blade 330. The treatment system 400 comprises a housing 440, an opening 450 in the housing 440, a linear slide 430, an adapter plate 420 attached to the linear slide 430, a brush motor 410 attached to the adapter plate 420, and a brush 412 attached to a rotary shaft 414 of the brush motor 410. The linear slide 430 is linearly actuatable relative to the housing 440. For example, the linear slide 430 may be a Bimba® Series 15 linear slide with a 400 millimeter stroke length and a 2.5 millimeter lead ball screw available from Bimba Manufacturing Company of University Park, Ill., part number LP15SA400SD101NS. The linear slide 430 moves the adapter plate 420 and the brush motor 410 back and forth relative to the housing 440 in a longitudinal direction LD (FIGS. 8 and 9). In at least one aspect, the linear slide 430 is actuated by an actuator motor which may comprise a direct drive NEMA 43 standard stepper motor available from Kollmorgen Corporation of Radford, Va. The actuator motor drives the 2.5 millimeter lead ball screw and, thus, can translate the linear slide 430 in the longitudinal direction LD, for example. The treatment system 400 can be used to remove flaws such as burrs or edge defects from the blade 330 of an ice skate 300, for example. The ice skate 300 is similar in many respects to ice skates 100 and 200. For example, the ice skate 300 comprises a boot 310, a chassis 320 extending downwardly from the boot 310, and the blade 330 extending downwardly from the chassis 320. Further, the blade 330 comprises two opposing faces, two edges, and a hollow, similar to blade 130 (FIG. 2A), for example.

Referring primarily to FIG. 9, the blade 330 of the ice skate 300 is placed through the opening 450 in the housing 440 of the treatment system 400. The opening 450 in the housing 440 is an elongate slot that is sized to operably receive the blade 330 of the ice skate 300, for example. The opening 450 may be sized such that it reduces access to the moving parts of the treatment system 400 and, thus, reduces incidences of injury to an operator of the treatment system 400.

In at least one instance, the treatment system 400 comprises a clamp 445 configured to hold the blade 330 in place relative to the housing 440 and the opening 450, for example. For example, a clamping system can be used for a blade in instances in which a grinding wheel of a treatment machine is replaced with a filament brush for a secondary brushing treatment. In such instances, the original clamping mechanism employed by the treatment wheel during a grinding treatment can be utilized during the secondary brushing treatment. For the secondary treatment, the grinding wheel would be replaced with a rotary brush, such as one of the brushes described herein, and the rotary driver for the treatment machine can have an adjustable speed (RPM) that can correspond to the requirements of the secondary brushing treatment. Additionally, in certain instances, the distance between the blade and the rotary driver can be adjusted such that the blade enters the rotary brush a suitable distance.

Figure 14:
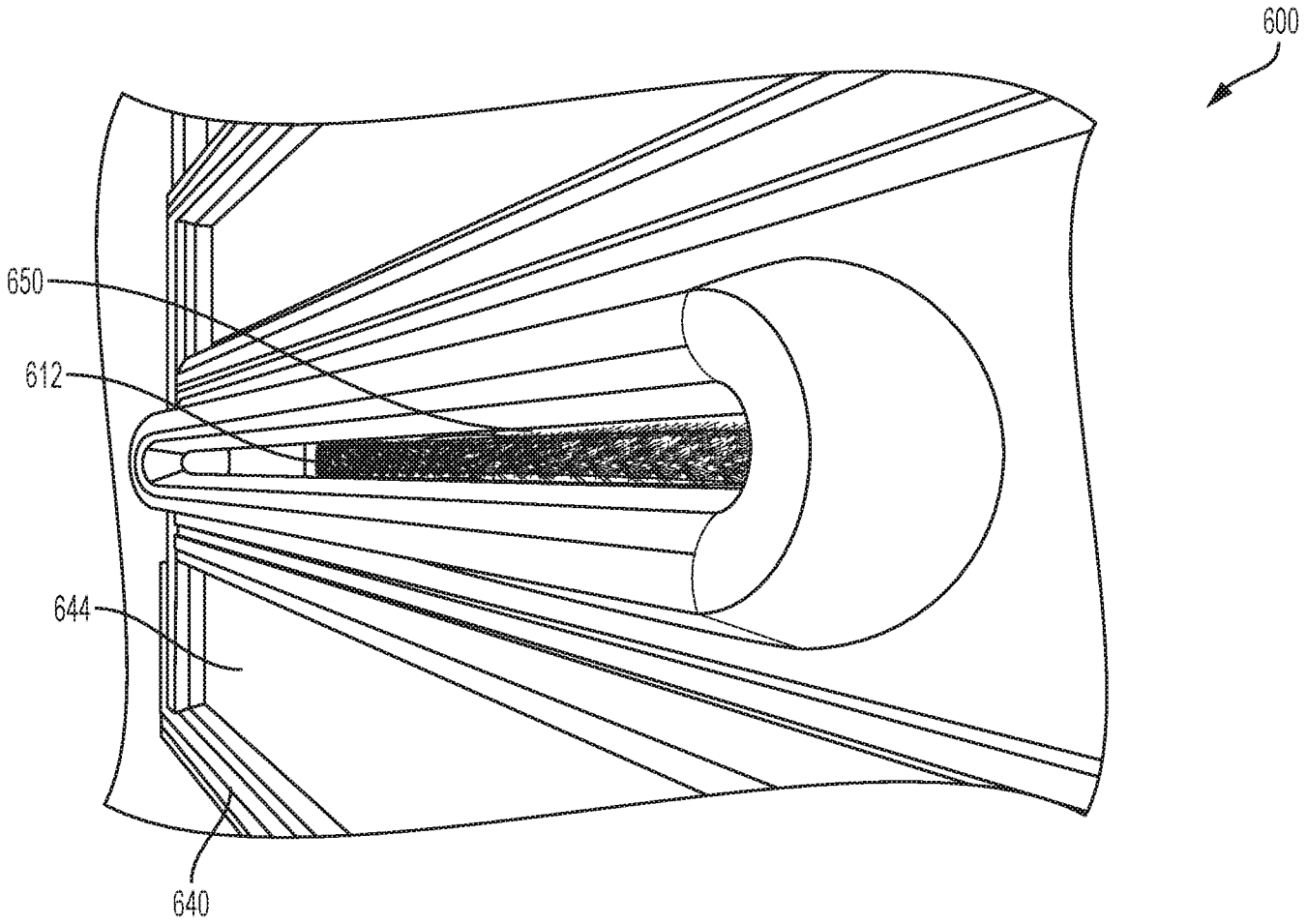
FIG. 14 is a perspective view of the treatment system of FIG. 12, depicting the cover plate of the protective housing and further depicting a skate receptacle for receiving an ice skate, in accordance with at least one aspect of the present disclosure.

Other arrangements are envisioned where the weight of the ice skate 300 holds the blade 330 in place relative to the housing 440 (see, e.g. opening 650 in FIG. 14). In other words, a clamp for the skate and/or blade is not required in certain instances. Arrangements without a clamp can provide a simple design, high level of repeatability, and require minimal operator training or instruction to achieve a consistent result.

In any event, after the ice skate 300 is secured relative to the housing 440 via gravity, a clamp, or other holding means, the brush motor 410 can be powered on to rotate the brush 412 relative to the blade 330. Further, the linear slide 430 moves longitudinally in direction LD (FIGS. 8 and 9) to move the brush 412 relative to the blade 330. The brush 412 is rotated, brought into contact with the blade 330, and moved longitudinally along the blade 330 to perform a secondary treatment. In certain instances, the brush 412 can be rotated in a clockwise direction $D_{CW}$ (FIG. 8) relative to the linear slide 430 or a counter clockwise direction $D_{CCW}$ (FIG. 9) relative to the linear slide 430, for example. In other words, the brush 412 can rotate relative to the ice skate 300 and blade 330 in either a clockwise direction or a counter clockwise direction to effectively remove the burrs and/or edge defects. In other instances, the ice skate 300 and/or the blade 330 can move relative to the brush 412 to perform the secondary treatment. Operation of the treatment system 400 is described in further detail below.

Referring again to FIGS. 8 and 9, the linear slide 430 can be actuated by an actuator motor, as described herein. The actuator motor can be programmed to translate the linear slide 430 at a predetermined speed for a specified number of passes depending on a desired treatment cycle for the blade 330. More specifically, the brush 412 can traverse the length of the blade 330 at the predetermined speed and apply pressure to the blade 330, which allows the brush 412 to contact the hollow, the faces, and the edges of the blade 330. Further, the rotational speed and/or direction of the brush 412 can be predetermined and pre-programmed based on the severity of the flaws present on the blade 330. The brush 412 may have to establish sufficient overlap with the blade 330 during processing to address the burr or edge flaws that protrude beyond the width of the blade 330. In certain instances, the brush 412 can be at least three times wider than the width of the blade 330, for example. The brush 412 is configured to conform around the edges of the blade 330 to contact both of the faces of the blade 330 in order to remove or level any protruding or distorted surfaces that may have been created by the grinding treatment to hone the blade to a desired condition. For example, the brush 412 is configured to contact the edges of the blade 330 to remove burrs and/or edge distortion created by the grinding process. Further, the contact between the brush 412 and the hollow of the blade 330 can improve the surface finish of the ground surface (e.g., the surface finish of the hollow), assisting in at least partially removing the surface flaws generated during the grinding operation, including minor scratching or grinding chatter. The smoother finish of the hollow and sharper edges allows for less drag, or resistance, between the blade 330 and the ice.

In at least one instance, the brush 412 can comprise a plurality of flexible filaments employing abrasive media such as aluminum oxide, silicon carbide, PCD crystals, natural diamond, and combinations thereof. The abrasive media can be extruded to create the flexible filaments and/or placed on the exterior of the flexible filaments. In at least one aspect, the brush 412 can comprise 600-grit natural diamond, supported in a plastic matrix filament, and a high density filament-filled plastic core brush that is one-piece. In certain instances, the brush 412 may be 10 millimeters wide by 150 millimeters in diameter with a 50 millimeter mounting hole, for example. In certain instances, the filament design of the brush 412 may be 0.038 millimeter in diameter, straight, non-kinked variety, which is available from Weiler Corporation of Cresco, Pa. (originally developed for Conicity Technologies of Latrobe, Pa. by Weiler Corporation), for example.

The action of the brush 412 on the blade 330 can provide various functions. For example, the center portion of the brush 412 intersects and follows the hollow of the blade 330 to smooth the surface flaws created by the grinding treatment, such as scratches and grinding surface chatter. Additionally, the brush 412 is designed to slide simultaneously along the parallel faces and edges of the blade 330. As the brush 412 rotates, it will wear or abrade away any surface defects, thus, removing edge burrs and/or corner distortion and leaving the edges and the faces of blade 330 free of flaws.

Figure 10:
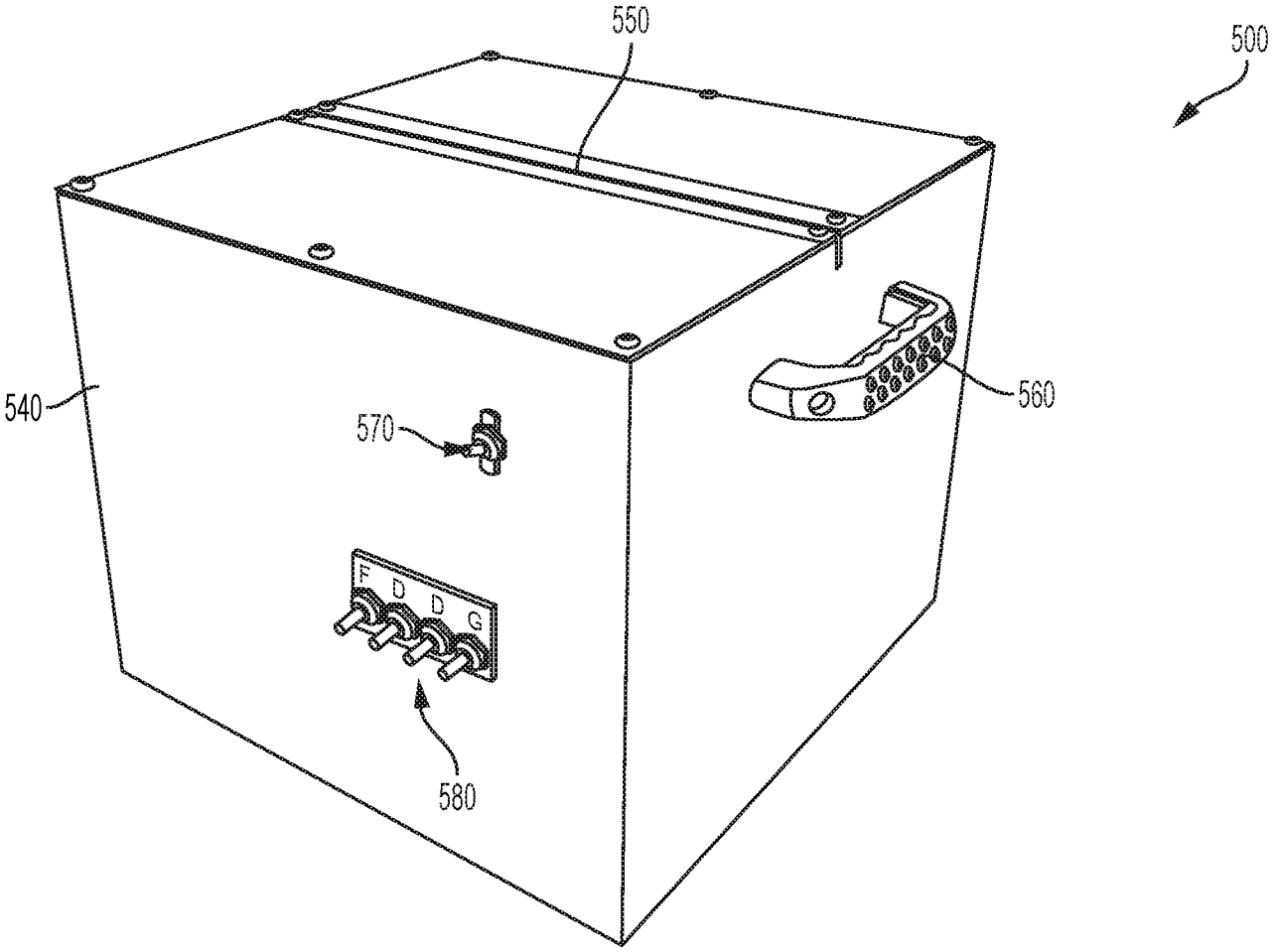
FIG. 10 is a perspective view of a treatment system including a protective housing having a longitudinal slot defined therein, in accordance with at least one aspect of the present disclosure.
Figure 11:
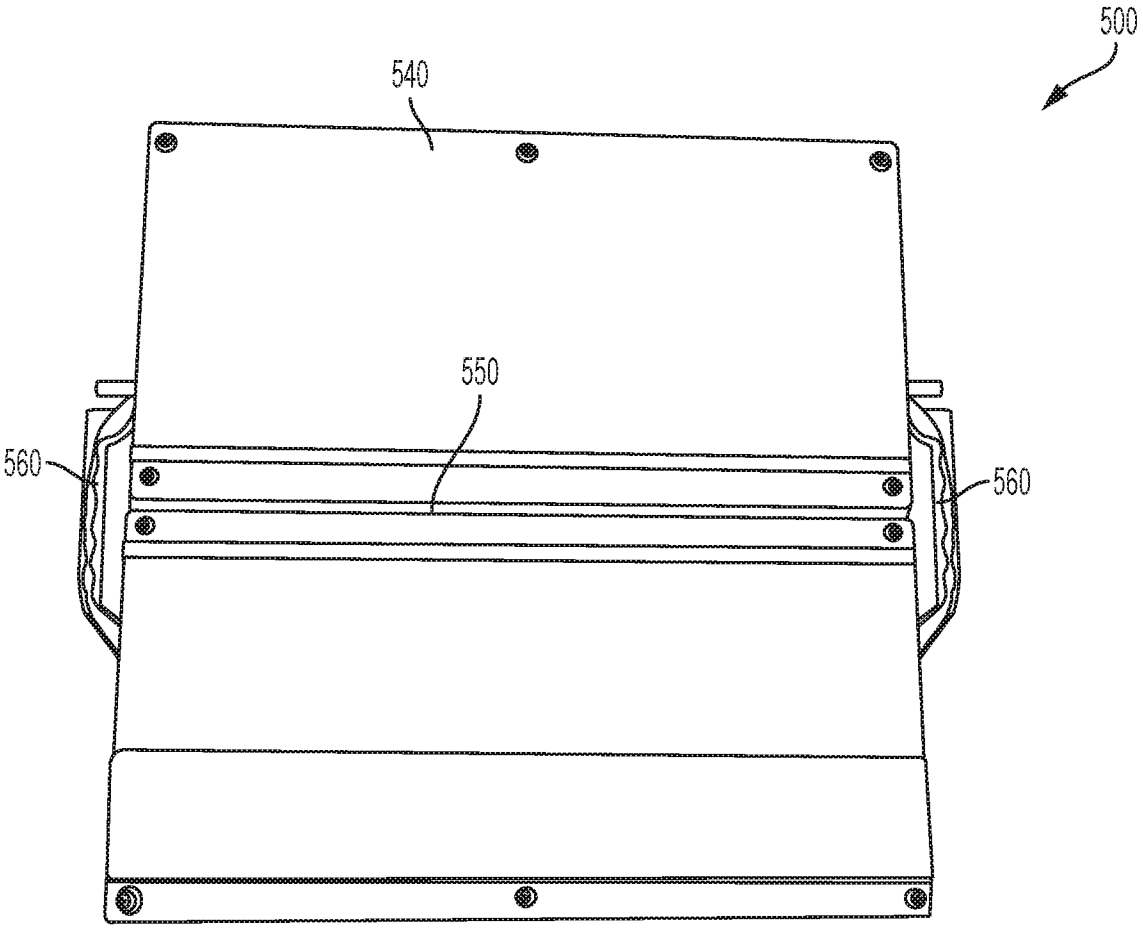
FIG. 11 is a plan view of the treatment system of FIG. 10, in accordance with at least one aspect of the present disclosure.

FIGS. 10 and 11 depict a treatment system 500 for removing edge and surface defects from an ice skate blade. The treatment system 500 is similar in many respects to the treatment system 400. For example, the treatment system 500 can incorporate various components of the treatment system 400, such as the linear slide and/or rotary brush, for example. The treatment system 500 comprises a housing 540, a longitudinal slot 550 in the top of the housing 540, and at least one handle 560. The housing 540 protects the internal components of the treatment system 500 and prevents an operator of the treatment system 500 from coming into contact with the internal moving parts of the treatment system 500. The longitudinal slot 550 is configured to allow a blade of an ice skate to enter into the housing 540. The handle(s) 560 allow an operator of the treatment system 500 to easily move the treatment system 500 from one place to another. Although only one handle 560 is shown in FIG. 10, the reader will appreciate that the housing 540 can include two or more handles, which can be positioned around the perimeter of the housing 540 to facilitate lifting and/or relocation of the treatment system 500 by one or more individuals.

The treatment system 500 also includes a master switch 570 and treatment cycle switches 580. The master switch 570 is configured to operably supply power to one or more motors of the treatment system 500 from a power supply. In at least one instance, the master switch 570 can only be turned on when all of the treatment cycle switches 580 are turned off, for example. Once the master switch 570 has been turned on, one of the treatment cycle switches 580 can be selected. In certain instances, each of the treatment cycle switches 580 can correspond to a different treatment cycle for a given blade condition and/or hollow configuration. In other instances, the treatment system 500 may not include alternative treatment cycles. For example, actuation of the master switch 570 can actuate a generic treatment cycle, which can be suitable for deburring and honing the ice skate blades. In such instances, the generic treatment cycle can be universal to all blade conditions and/or hollows, as further described herein.

Figure 12:
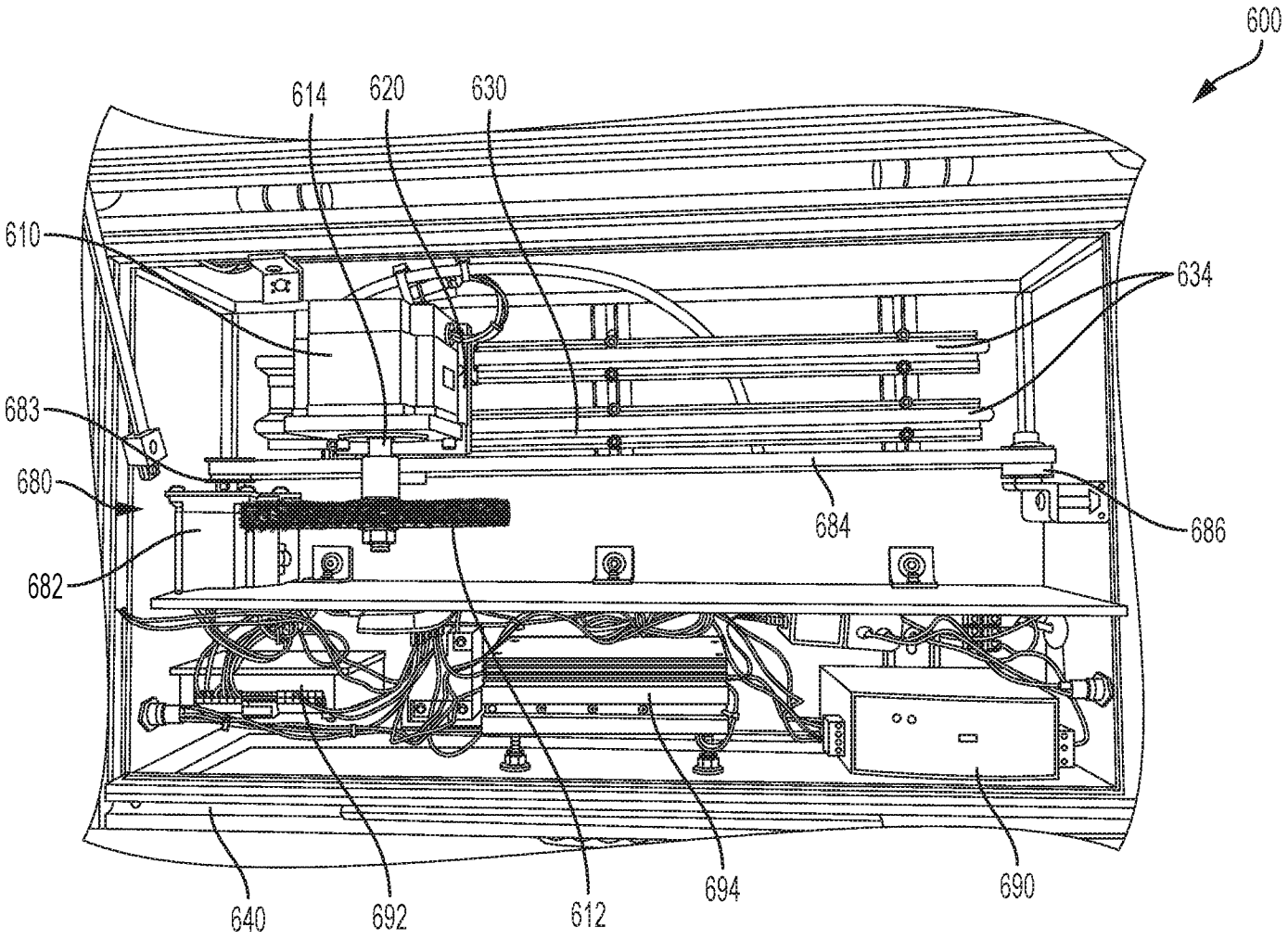
FIG. 12 is a plan view of a treatment system for ice skate blades in which a cover plate of a protective housing of the treatment system has been removed to reveal various internal components of the treatment system including a power supply, a transformer, a motor controller, and a linear actuator, in accordance with at least one aspect of the present disclosure.
Figure 13:
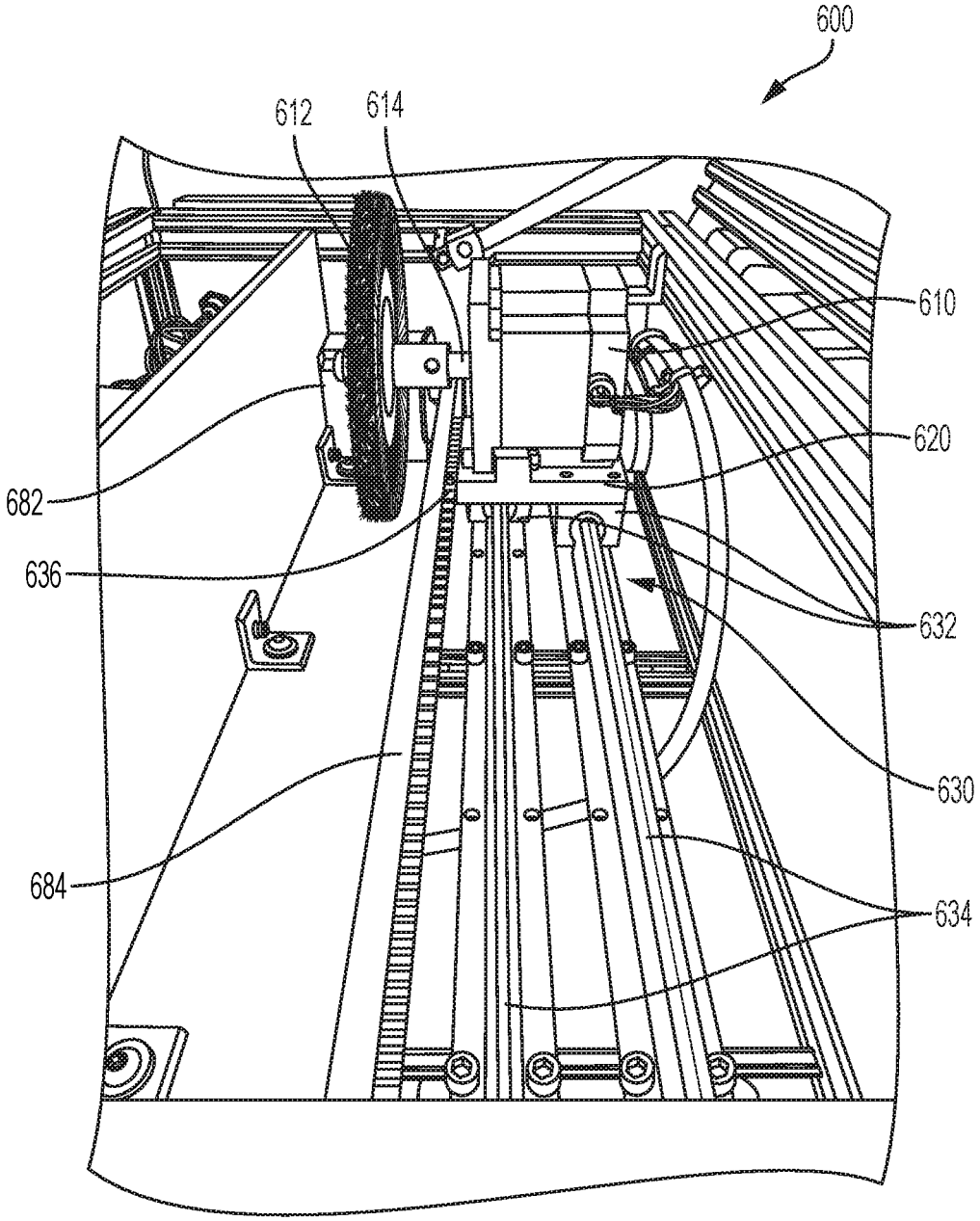
FIG. 13 is a perspective view of certain internal components of the treatment system of FIG. 12, in accordance with at least one aspect of the present disclosure.

FIGS. 12 and 13 depict a treatment system 600 for removing edge and surface defects from an ice skate blade. The treatment system 600 is similar in many respects to the treatment systems 400 and 500. For example, the treatment system 600 includes a housing 640, a linear slide 630, an adapter plate 620 attached to the linear slide 630, a brush motor 610 attached to the adapter plate 620, and a brush 612 attached to a rotary shaft 614 of the brush motor 610. The treatment system 600 also includes a linear actuator 680 configured to linearly actuate a carriage 632 of the linear slide 630. The carriage 632 of the linear slide 630 is attached to the adapter plate 620, which is attached to the brush motor 610. The linear slide 630 further comprises two parallel rods or rails 634 which are attached to and extend along the length of the housing 640. In at least one arrangement, the carriage 632 includes slide bearings that interact with the rails 634 to allow the carriage 632 to slide freely along the rails 634. The carriage 632 comprises two separate blocks which can span different portions of the rails 634, wherein each separate block is attached to the adapter plate 620 as shown in FIG. 13. Other arrangements are envisioned where the carriage 632 can comprise one solid block attached to the adapter plate 620, for example. In any event, the carriage 632 translates relative to the housing 640 when acted upon by the linear actuator 680, as further described herein.

In one arrangement, for example, the linear actuator 680 comprises an actuator motor 682 fixed to one end of the housing 640, a belt 684, and an end gear 686 fixed to another end of the housing 640. In at least one aspect, the brush motor 610 and the actuator motor 682 are may comprise stepper motors from Kollmorgen Corporation, for example. The actuator motor 682 comprises a rotary shaft 683 (FIG. 12) extending therefrom that is configured to output rotary motions. The belt 684 can be a rubber timing belt that is positioned around the rotary shaft 683 and around the end gear 686 in a loop. The rotary shaft 683 is drivingly engaged with the belt 684 and, thus, drives the belt 684 around the loop. As the belt 684 moves around the loop, the carriage 632 translates within the housing 640. In other words, the actuator motor 682 is configured to linearly actuate the carriage 632 of the linear slide 630 and, thus, linearly actuate the adapter plate 620, the brush motor 610, and the brush 612, as further described herein. Various alternative linear actuators are contemplated.

The adapter plate 620 comprises a protrusion 636 extending from the adapter plate 620. One side of the belt 684 is attached to the protrusion 636 such that, as the belt 684 moves longitudinally, the adapter plate 620 will move longitudinally along the rails 634 of the linear slide 630. As the adapter plate 620 moves, the brush motor 610 and the brush 612 will move. In such instances, the actuator motor 682 can be used to move the brush 612 relative to the housing 640 to perform a secondary treatment operation. Other arrangements are envisioned comprising different gear and/or belt configurations to translate the brush motor 610 and the brush 612 relative to the housing 640. Operation of the brush motor 610 and the actuator motor 682 is further described herein. Moreover, in other instances, a single motor and a transmission can be configured to actuate the linear actuator and the rotary brush.

The treatment system 600 also includes a power supply 690, a transformer 694 connected to the power supply 690, and a motor controller 692 in signal communication with the brush motor 610 and the actuator motor 682. The power supply 690 is configured to supply power to the brush motor 610, the actuator motor 682, and the motor controller 692 through the transformer 694. The power supply 690 can be any suitable means for storing electricity, such as a battery pack and/or a rechargeable battery, for example. Other arrangements are envisioned where the treatment system 600 can be plugged into a standard 110-volt wall outlet to power the treatment system 600. In any event, the power supply 690 supplies power to the motor controller 692, the brush motor 610, and the actuator motor 682. The motor controller 692 is configured to control the outputs (e.g., RPM and direction, for example) of the brush motor 610 and the actuator motor 682. The motor controller 692 can be programmed to effectuate a desired RPM for the brush 612 by controlling the brush motor 610. Further, the motor controller 692 can be programmed to effectuate a desired translating speed and/or distance for the carriage 632 of the linear slide 630. Therefore, the brush 612 can be rotated and translated relative to a blade of a skate to perform a secondary treatment operation.

Turning now to FIG. 14, a cover plate 644 of the treatment system 600 is shown. The cover plate 644 covers the top of the housing 640 and comprises a receptacle 650 that is configured to receive a blade of an ice skate. The cover plate 644 protects the internal components of the treatment system 600. The receptacle 650 is sized such that the blade of a skate, such as the blade 130 of the ice skate 100 (see FIGS. 1 and 2), can fit into the receptacle 650 and be held in place during a secondary treatment. In certain instances, the ice skate blade and/or chassis of the skate can be press-fit into the receptacle 650, such that the blade will not move during the secondary treatment, for example. Different size receptacles may be utilized for different skates and/or blade sizes. In certain instances, to accommodate different skates and/or blades, the receptacle 650 can be interchangeable with the cover plate 644. For example, an alternative receptacle can be secured to the cover plate 644. The alternative receptacle can be press-fit or friction fit into an opening of the cover plate 644 and/or can be secured with clips and/or fasteners, for example. In still other instances, the entire cover plate 644 can be removed and replaced with an alternative cover plate comprising a different receptacle geometry.

The receptacle 650 is fixed relative to the housing 640. In other instances, the receptacle can be configured to move relative to the housing 640. For example, a linear actuator, as described herein, can be configured to move the receptacle along a slot and/or rails during a treatment cycle. In such instances, the rotary brush 612 may rotate but not translate relative to the receptacle 650. In other instances, both the rotary brush 612 and the receptacle 650 can translate relative to the housing 640.

Figure 15:
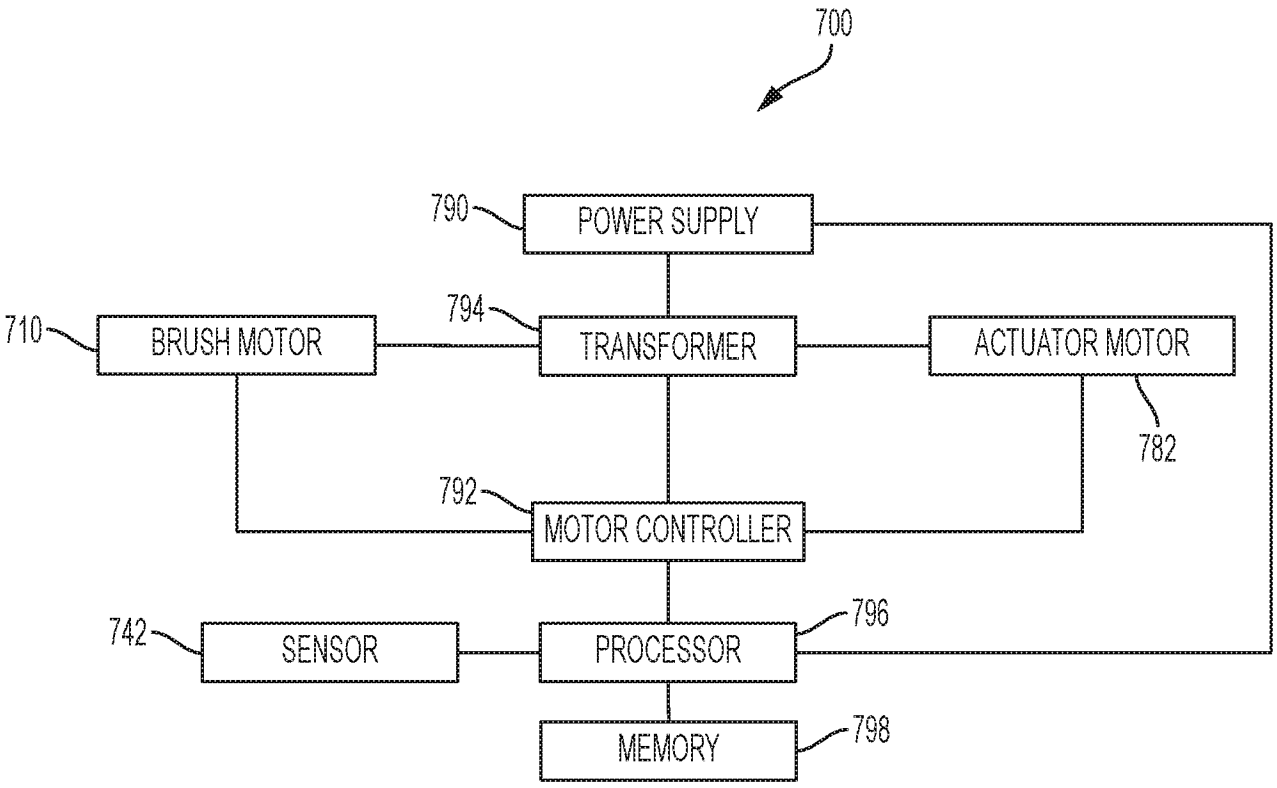
FIG. 15 is a schematic of a treatment system, in accordance with at least one aspect of the present disclosure.

FIG. 15 is a schematic of a treatment system 700 for removing edge and surface defects from an ice skate blade. The treatment system 700 can be similar in many respects to treatment systems 400, 500, and 600. For example, the treatment system 700 comprises a power supply 790, a transformer 794 connected to the power supply 790, a brush motor 710, an actuator motor 782, and a motor controller 792. The power supply 790 supplies power to the brush motor 710, the actuator motor 782, and the motor controller 792 via the transformer 794. In certain instances, the power supply 790 can be a 24-volt power supply as available from Murrelektronik GmbH of Germany, or another suitable power supply. Other arrangements are envisioned where the treatment system 700 can be plugged into a standard 110-volt AC 15-amp standard wall outlet to power the treatment system 700. In at least one arrangement, the transformer 794 is configured to convert a 110-volt AC input power to 24-volt DC operating current, for example. Other arrangements are envisioned with different power supplies for the brush motor 710, the actuator motor 782, the motor controller 792, and combinations thereof. Operation of the treatment system 700 is further described herein.

The motor controller 792 is in signal communication with the brush motor 710 and the actuator motor 782 and is configured to control the direction of rotation and/or the velocity of the brush motor 710 and the actuator motor 782. In certain instances, the motor controller 792 may be a model MC405 3-axis controller from Trio Motion Technology of Gloucestershire, United Kingdom, or another suitable motor controller. Other arrangements are envisioned where the brush motor 710 and the actuator motor 782 are controlled by different motor controllers. A sensor 742 is in signal communication with the motor controller 792 and is configured to detect the position of a blade (e.g., blade 130, blade 230, or blade 330, for example) when the blade is inserted through an opening of the treatment system 700. The sensor 724 is also in signal communication with the motor controller 792. The treatment system 700 further comprises a processor 796 and a memory 798. The processor 796 is in signal communication with the sensor 742, the motor controller 792, the brush motor 710, and the actuator motor 782. The memory 798 stores data for use by the processor 796 and/or stores data received from the processor 796. In various instances, the processor 796 may control the motor controller 792 to control the direction of rotation and/or velocity of the brush motor 710 and/or the actuator motor 782. Further, the processor 796 may start and stop the brush motor 710 and/or the actuator motor 782 based on input received from the sensor 742. The input received from the sensor can comprise data indicating whether or not the blade inserted through the opening of the treatment system 700 is in a proper position.

It should be understood that the term "processor" as used herein includes any suitable microprocessor, microcontroller, or other basic computing device that incorporates the functions of a computer's central processing unit (CPU) on an integrated circuit or, at most, a few integrated circuits. In one form, the processor is a multipurpose, programmable device that accepts digital data as input, processes it according to instructions stored in its memory, and provides results as output. It is an example of sequential digital logic, as it has internal memory. Processors operate on numbers and symbols represented in the binary numeral system.

Figure 16:
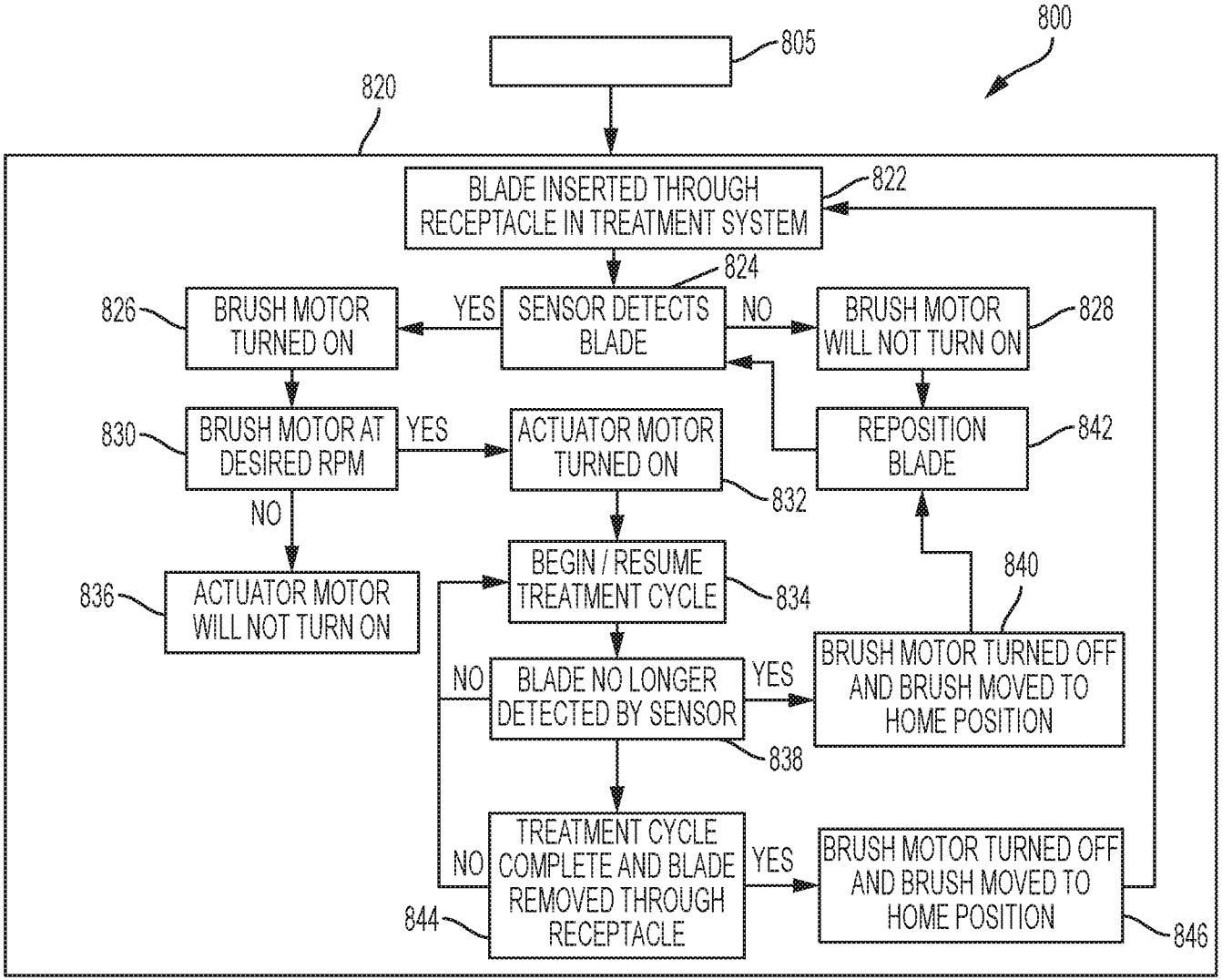
FIG. 16 is a flow chart depicting a method for treating an ice skate blade, in accordance with at least one aspect of the present disclosure.

Turning now to FIG. 16, a flow diagram of a treatment sequence 800 including a primary treatment 805 and a secondary treatment 820 is depicted. The primary treatment 805 is a grinding treatment, such as the grinding of an ice skate blade utilizing a grinding wheel, as depicted in FIG. 5, for example. After completion of the primary treatment 805, the secondary treatment 820 can be initiated.

The secondary treatment 820 may be performed with a treatment system such as one of the treatment systems 400, 500, 600, and 700, as described herein. In one instance, the secondary treatment 820 is performed with the treatment system 600 including the brush 612 attached to the brush motor 610, the linear actuator 680, the actuator motor 682 configured to drive the linear actuator 680, and the motor controller 692 in signal communication with the brush motor 610 and the actuator motor 682, as further described herein. After grinding a blade during the primary treatment 805, the blade (e.g., the blade 130, the blade 230, or the blade 330, for example), which can be off the skate, attached to the boot via the chassis, or attached to the chassis, is inserted into the receptacle 650 of the treatment system 600 to begin the secondary treatment 820 at step 822.

After the blade is inserted through the receptacle 650 in the treatment system 600 at step 822, a sensor, such as the sensor 742 (FIG. 15) detects the position of the blade through the receptacle 650 at step 824. If the sensor 742 detects that the blade is in the proper position, the brush motor 610 will automatically turn on at step 826. However, if the sensor 742 does not detect that the blade in the proper position, the brush motor 610 will not turn on (step 828), and the blade must be repositioned at step 842 until the sensor 742 detects the blade in the proper position at step 824. The reader will appreciate that it may take several iterations to properly position the blade within the receptacle 650. If a blade or skate is incompatible with the treatment system 600 and/or the cover plate and/or opening thereof, the secondary treatment will not proceed to step 826 and the brush motor 610 will not be powered on. In other instances, the treatment system may not include a sensor and/or the treatment system can include an override feature, which can override the feedback from the sensor to complete the secondary treatment 820.

Referring again to FIG. 16, when the blade is in the proper position and detected by the sensor 742, the motor controller 692 instructs the brush motor 610 to run at a pre-programmed RPM and, thus, to rotate the brush 612 at a desired speed at step 830. If the brush motor 610 has not reached the desired RPM, the actuator motor 682 will not turn on at step 832, thus preventing the brush 612 from contacting the blade at an undesired RPM. In certain instances, a suitable brush RPM for burr and edge defect removal is between 250 and 700 RPM. RPMs at the higher end of the range can be selected if more aggression is required to remove all of the grinding defects. Further, a suitable translation velocity for the linear slide 630 and, thus, the brush 612, is 2-6 inches per second (50-150 mm/sec), for example. Moreover, a suitable number of passes (e.g., a back and forth translation of the brush 612 relative to the blade) to remove all of the burrs and edge defects is three. However, any suitable number of passes can be utilized. For example, all of the burrs and edge defects may be removed after a single pass or after two passes. However, in certain instances, a third pass can further increase the smoothness of the blade and will not harm the blade.

The secondary treatment 820 will proceed to step 836 and the actuator motor 682 will not be powered on until the brush motor 610 achieves the desired RPM. Once the brush motor 610 reaches the desired RPM at step 830, the actuator motor 682 is automatically turned on at step 832 and the brush 612 will make several linear passes back and forth relative to the blade to initiate the treatment cycle at step 834. As the brush 612 moves past the blade, the brush 612 is positioned to contact the blade and complete the treatment cycle. The number of times that the linear actuator 680 moves the brush 612 back and forth relative to the blade can be a programmable variable that can be stored in a memory, for example the memory 798 (FIG. 15), of the treatment system 600 and implemented by the motor controller 692. In certain instances, the speed of the brush 612, the speed of the linear actuator 680, and/or the number of passes of the linear actuator 680 can be pre-programmed or preset. In other instances, an operator can adjust the speed of the brush 612, the speed of the linear actuator 680, and/or the number of passes of the linear actuator 680. For example, the adjustments can be tuned to remove burrs and edge defects/irregularities formed by the grinding process, as described herein.

Referring still to FIG. 16, in the event that the blade is removed from the receptacle 650 or is moved to an improper position during the treatment cycle, the sensor 742 will no longer detect that the blade is in the proper position at step 838. If this occurs, the brush motor 610 will automatically turn off and the linear actuator will move the brush 612 to a home position away from the receptacle 650 and, thus, away from the blade at step 840. In such instances, the blade must be repositioned within the receptacle 650 at step 842 and determined to be in the proper position by the sensor 742 for the treatment cycle to resume.

Once the prescribed number of passes has been performed by the linear actuator 680, the treatment cycle is completed at step 844. After the treatment cycle is complete, the brush motor 610 is turned off, and the brush 612 is moved to the home position by the linear actuator 680 at step 846. To begin a new treatment cycle, the blade, or another blade, must be inserted through the receptacle 650 and detected by the sensor 742, as described herein. A typical treatment cycle time for the treatment process described above is 30 seconds, including loading and unloading of the blade, for example. Moreover, in certain instances, the automated cycle described herein can be initiated by activation of a start button or actuator on the housing 640 of the treatment system 600. The housing 640 can include a display for showing the status of the treatment system 600. For example, while a treatment cycle is running, a red in-process light can be illuminated and/or flash, and may turn off upon completion of the cycle. Additionally or alternatively, a green light can be illuminated and/or flash when the cycle is complete and/or when the treatment system 600 is ready to start a new cycle. In certain instances, one or more sensors described herein can determine the status of the treatment system 600, and the detected status can be communicated to an operator, as described herein.

In certain instances, the treatment sequence 800 and the secondary treatment 820 thereof can comprise specific programs tailored for processing skates or skate blades worn by forwards, defensemen, goalies, and/or for a specific geometry of blade hollow. In certain instances, the programming can comprise specific programs tailored for processing skates or skate blades with radius hollow blades, flat-bottomed "V" hollow blades, and/or other hollow geometries. In other words, the secondary treatment 820 can be programmed to process blades with varying blade widths, blade hollows, and edge sizes. The amount of burrs and/or edge defects can vary with the size of the hollow that is ground into the skate blade, as well as the width of the blade and the type of grinding process used. For example, goalie blades are 30% wider than forward or defensemen blades. Therefore, grinding a thicker goalie blade can require a higher level of pressure, which increases grinding heat, which can significantly increasing the severity of the corner flaws and edge irregularities and, thus, may require different parameters to be set to correct the blade defects/irregularities.

Further to the above, a blade (e.g., such as blade 130, 230, or 330 for example) can be processed in any of the treatment systems 400, 500, 600, and 700 with the blade mounted to a skate. Other arrangements are envisioned in which the blade is removed from the skate and processed in the treatment systems. In other words, the blade can be removed and processed in the treatment systems on a work bench or on the floor, for example, while the skate is still being worn by the skater. Further still, other arrangements are envisioned where just the blade and the chassis (e.g., the chassis 120, 220, or 320, for example) can be processed in any of the treatment systems disclosed herein.

The secondary treatment systems 400, 500, 600, and 700 can be completely mobile. For example, the various secondary treatment systems disclosed herein can measure 300 millimeter high, 250 millimeter deep and 500 millimeter long, and weigh 10 Kg. The treatment systems can be situated in a horizontal position on the floor or on a work bench surface.

In certain instances, individual skater preferences and/or the position of a hockey player can correspond to particular hollow geometries. As an example, a hockey forward may prefer a shallower hollow, which may allow the skater to achieve greater speeds on the ice and improved glide, but may sacrifice a degree of maneuverability that is associated with a deeper hollow. On the other hand, a defenseman may opt for a deeper hollow, which may provide increase maneuverability for starting, stopping, and/or turning, but may sacrifice a degree of speed (i.e., the skate may achieve less glide if a shallower hollow is used).

In certain instances, the secondary treatments disclosed herein can achieve a significant reduction in friction at the blade-ice interface such that a hockey forward may elect to use a shallower hollow, in combination with the secondary treatments disclosed herein, because the shallow hollower can achieve increased speeds and glide and the deburred blade can provide improved maneuverability that emulate the maneuverability of a deeper hollow. In other instances, a hockey defenseman may elect a hollow geometry that is typically more common for hockey forwards, i.e., shallower, in combination with the secondary treatments disclosed herein, in order to achieve increased speeds without sacrificing maneuverability. Reducing friction at the blade-ice interface with the secondary treatments disclosed herein can also allow skaters to achieve greater speeds and/or improve their performance while reducing the skater's physical exertion.

As described herein, burrs and other grinding flaws on a blade can increase friction at the blade-ice interface. Therefore, a reduction in friction is expected when the burrs and other grinding flaws are removed. Prior to the initial testing on the secondary treatments disclosed herein, a five to ten percent reduction in gliding friction was expected. However, with the burrs and grinding flaws removed by the secondary treatments disclosed herein that employ abrasive-filament brushes, for example, the tested blades demonstrated significantly improved reductions in friction and improvements in glide. The removal of the burrs and grinding defects also allow the skate to gain greater contact, or an increased footprint, with the ice, which promotes the stability of the skater, and increases the ability of the skater to start, stop, and turn at faster speeds.

Tests were conducted to evaluate the effectiveness of the secondary treatments disclosed herein. The tested blades underwent a secondary brushing treatment, as described herein. The secondary brushing treatment utilized an abrasive filament brush comprising radially-extending flexible bristles, such as the brush 612 shown in FIGS. 12, 13, and 14. In a first test, the "stiction force", i.e. the force required to move the skate along the ice from a stopped position, was determined.

The control blade was a sharpened blade that was treated with a primary, grinding treatment but not with any type of secondary treatment. The test blade was like the control blade but was further treated with a secondary brushing treatment. A secondary stoning treatment was not applied to the test blade. The rotary brush treatment may be more effective on a sharpened blade that has not undergone a secondary stoning treatment because the grinding flaws are in their original position and have not deformed by the stone. The secondary brushing treatment utilized a rotary brush comprising abrasive filament bristles, such as the brush 612 (FIGS. 12, 13, and 14), for example. The secondary treatment performed on the test blade utilized a brush speed of 600 RPM and was given three full passes of the brush along the blade. Further, the translation speed of the brush relative to the skate blade for each pass was approximately 5 inches per second (127 mm/sec).

For these tests, a force gauge was secured to a frame of the skate directly behind the front of the boot of the skate. Specifically, a steel bar was inserted through openings on the blade mount portion of the boot directly behind the tow area of the boot. The force gauge was secured to the steel bar by a nylon strap and bungee cord. During the test, the skates were worn by a 210-lb skater positioned on the ice. With the blades of the skates substantially parallel, approximately 10 inches (254 mm) apart, and the skater's body weight distributed substantially equally between the skates, the skater was pulled along the ice. For the stiction test, the force was measured by the force gauge at the instant the skater initially began to move forward, i.e. began to break-away from a stationary position. The force gauge was pulled horizontally to determine the amount of force required to move the skate horizontally across the ice. The test indicated that the stiction force for the test blades was approximately 40% less that the stiction force for the control blade. In other words, the friction at the blade-ice interface was significantly reduced with the test blade versus the control blade. It is also estimated that the "drag force", i.e., the force required to keep the skater moving after the stiction force had been normalized or overcome, is reduced by approximately 25% to 30% for a blade treated with the secondary brushing treatment described herein.

In another test, the same skater wore one ice skate with a blade that had been treated with a secondary stoning treatment ("the control blade") and one ice skate with a blade that had been treated with the secondary brushing treatment described herein ("the test blade"). The skater was not informed of the position of the two differently-processed blades and was asked to skate aggressively making tight turns and abrupt starts and stops. The skater attempted high stress movements, high speed sprinting, and gliding on the ice. The skater was then asked for his impression concerning the difference in "feel" between his right skate and his left skate. He explained that he could feel the difference, blade to blade. He said one blade, when compared to the other blade, was "giving-up" on starting, stopping and turning. The blade that showed higher performance was the test blade. For example, the skater reported feeling a smoother glide and a greater level of maneuverability with the test blade. Additionally, the test blade was noticeably louder in use than the control blade. The increased noise is a function of the increased contact (or footprint) between the blade and the ice, which corresponds to improved maneuverability for the skater.

The various secondary treatments disclosed herein utilizing a flexible brush to remove the burrs and surface defects can improve the quality of the blades such that the skaters need to exert less energy and/or have improved maneuverability, as further disclosed herein. Additionally, the incidences of lacerations by the treated blade may be reduced, as also disclosed herein. Furthermore, because the treatment process is substantially automated, the blades treated with an abrasive brush, as described herein, can be sharpened by operators without extensive sharpening skills or expertise. Blades treated with such secondary treatments may also need to be sharpened less frequently because breakdown of the blade edges is decelerated. More specifically, the blade "as ground" with a grinding wheel has a multitude of defects in the edges, as described herein. These defects can attribute to a quick breakdown of the corner because the edges are inherently weak. Once the defects and/or burrs are removed and the steel base metal of the blade has been smoothed, the corners of the steel blade have increased strength; therefore, normal wear is slower than with a blade that hasn't undergone the secondary brushing treatment described herein. Due to the slower breakdown of the edges of the blade, grinding of the blades can be performed at a reduced frequency.

EXAMPLES

Various aspects of the subject matter described herein are set out in the following numbered examples.

Example 1

An apparatus for treating an ice skate blade, the apparatus comprising a rotary brush, an electric motor, and a receptacle dimensioned to position the ice skate blade relative to the rotary brush. The rotary brush comprises a hub, wherein a brush axis extends through the hub. The rotary brush further comprises a plurality of bristles extending radially from the hub. The electric motor is drivingly coupled to the rotary brush and operably configured to rotate the bristles about the brush axis.

Example 2

The apparatus of Example 1, further comprising a linear actuator.

Example 3

The apparatus of Example 2, wherein the linear actuator is configured to move the rotary brush relative to the ice skate blade.

Example 4

The apparatus of Example 3, wherein the ice skate blade extends along a blade axis when positioned in the receptacle, and wherein the linear actuator is configured to move the rotary brush along a longitudinal axis that is parallel to the blade axis.

Example 5

The apparatus of Example 2, wherein the linear actuator is configured to move the receptacle relative to the rotary brush.

Example 6

The apparatus of any one of Examples 1-5, further comprising an input device and a control circuit configured to: receive an input signal from the input device and send an output signal to the electric motor based on the input signal from the input device.

Example 7

The apparatus of Example 6, further comprising a housing configured to enclose the rotary brush and the control circuit.

Example 8

The apparatus of any one of Examples 1-7, wherein the rotary brush comprises an abrasive filament brush comprising flexible bristles.

Example 9

The apparatus of Example 8, wherein the flexible bristles comprise diamond filaments.

Example 10

The apparatus of any one of Examples 1-9, wherein the ice skate blade comprises a first width, and wherein the rotary brush comprises a second width that is greater than the first width.

Example 11

The apparatus of any one of Examples 1-10, wherein the receptacle comprises a longitudinal slot, and wherein at least a portion of the ice skate blade extends through the longitudinal slot.

Example 12

A method for treating an ice skate blade, the method comprising positioning an ice skate in a receptacle comprising a longitudinal slot, wherein the ice skate comprises a blade, and wherein at least a portion of the blade extends through the longitudinal slot. The method further comprising moving a rotary brush along a longitudinal path that is parallel to the longitudinal slot, wherein the rotary brush comprises a plurality of radially-extending flexible bristles configured to operably contact the blade as the rotary brush moves along the longitudinal path.

Example 13

The method of Example 12, wherein the radially-extending flexible bristles comprise diamond filaments configured to hone the blade.

Example 14

The method of any one of Examples 11 and 12, further comprising treating the ice skate blade with a grinding wheel before positioning the ice skate in the receptacle.

Example 15

The method of any one of Examples 12-15, wherein the blade comprises outer lateral sides, and wherein the method further comprises centering the blade relative to the rotary brush such that the radially-extending flexible bristles contact the outer lateral sides of the blade.

Example 16

A method for sharpening ice skate blades, the method comprising performing a primary treatment using a grinding wheel and performing a secondary treatment using an abrasive filament brush comprising flexible bristles.

Example 17

The method of Example 16, wherein the secondary treatment comprises positioning an ice skate in a receptacle and moving the abrasive filament brush along a longitudinal path and rotating the abrasive filament brush about an axis.

Example 18

The method of Example 17, wherein the abrasive filament brush is configured to rotatably contact a blade of the ice skate as the abrasive filament brush moves along the longitudinal path.

Example 19

The method of Example 18, further comprising automatically completing the secondary treatment after the abrasive filament brush has moved back and forth along the longitudinal path a preset number of times.

Example 20

The method of any one of Examples 16-19, further comprising actuating an actuator on a housing of the abrasive filament brush to automatically perform the secondary treatment.

While several forms have been illustrated and described, it is not the intention of the applicant to restrict or limit the scope of the appended claims to such detail. Numerous modifications, variations, changes, substitutions, combinations, and equivalents to those forms may be implemented and will occur to those skilled in the art without departing from the scope of the present disclosure. Moreover, the structure of each element associated with the described forms can be alternatively described as a means for providing the function performed by the element. Also, where materials are disclosed for certain components, other materials may be used. It is therefore to be understood that the foregoing description and the appended claims are intended to cover all such modifications, combinations, and variations as falling within the scope of the disclosed forms. The appended claims are intended to cover all such modifications, variations, changes, substitutions, modifications, and equivalents.

The foregoing detailed description has set forth various forms of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, and/or examples can be implemented, individually and/or collectively, by a wide range of hardware, software, firmware, or virtually any combination thereof. Those skilled in the art will recognize that some aspects of the forms disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, those skilled in the art will appreciate that the mechanisms of the subject matter described herein are capable of being distributed as one or more program products in a variety of forms, and that an illustrative form of the subject matter described herein applies regardless of the particular type of signal bearing medium used to actually carry out the distribution.

Instructions used to program logic to perform various disclosed aspects can be stored within a memory in the system, such as dynamic random access memory (DRAM), cache, flash memory, or other storage. Furthermore, the instructions can be distributed via a network or by way of other computer readable media. Thus a machine-readable medium may include any mechanism for storing or transmitting information in a form readable by a machine (e.g., a computer), but is not limited to, floppy diskettes, optical disks, compact disc, read-only memory (CD-ROMs), and magneto-optical disks, read-only memory (ROMs), random access memory (RAM), erasable programmable read-only memory (EPROM), electrically erasable programmable read-only memory (EEPROM), magnetic or optical cards, flash memory, or a tangible, machine-readable storage used in the transmission of information over the Internet via electrical, optical, acoustical or other forms of propagated signals (e.g., carrier waves, infrared signals, digital signals, etc.). Accordingly, the non-transitory computer-readable medium includes any type of tangible machine-readable medium suitable for storing or transmitting electronic instructions or information in a form readable by a machine (e.g., a computer).

As used in any aspect herein, the term "control circuit" may refer to, for example, hardwired circuitry, programmable circuitry (e.g., a computer processor comprising one or more individual instruction processing cores, processing unit, processor, microcontroller, microcontroller unit, controller, digital signal processor (DSP), programmable logic device (PLD), programmable logic array (PLA), or field programmable gate array (FPGA)), state machine circuitry, firmware that stores instructions executed by programmable circuitry, and any combination thereof. The control circuit may, collectively or individually, be embodied as circuitry that forms part of a larger system, for example, an integrated circuit (IC), an application-specific integrated circuit (ASIC), a system on-chip (SoC), desktop computers, laptop computers, tablet computers, servers, smart phones, etc. Accordingly, as used herein "control circuit" includes, but is not limited to, electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of random access memory), and/or electrical circuitry forming a communications device (e.g., a modem, communications switch, or optical-electrical equipment). Those having skill in the art will recognize that the subject matter described herein may be implemented in an analog or digital fashion or some combination thereof.

As used in any aspect herein, the term "logic" may refer to an app, software, firmware and/or circuitry configured to perform any of the aforementioned operations. Software may be embodied as a software package, code, instructions, instruction sets and/or data recorded on non-transitory computer readable storage medium. Firmware may be embodied as code, instructions or instruction sets and/or data that are hard-coded (e.g., nonvolatile) in memory devices.

As used in any aspect herein, the terms "component," "system," "module" and the like can refer to a computer-related entity, either hardware, a combination of hardware and software, software, or software in execution.

As used in any aspect herein, an "algorithm" refers to a self-consistent sequence of steps leading to a desired result, where a "step" refers to a manipulation of physical quantities and/or logic states which may, though need not necessarily, take the form of electrical or magnetic signals capable of being stored, transferred, combined, compared, and otherwise manipulated. It is common usage to refer to these signals as bits, values, elements, symbols, characters, terms, numbers, or the like. These and similar terms may be associated with the appropriate physical quantities and are merely convenient labels applied to these quantities and/or states.

A network may include a packet switched network. The communication devices may be capable of communicating with each other using a selected packet switched network communications protocol. One example communications protocol may include an Ethernet communications protocol which may be capable permitting communication using a Transmission Control Protocol/Internet Protocol (TCP/IP). The Ethernet protocol may comply or be compatible with the Ethernet standard published by the Institute of Electrical and Electronics Engineers (IEEE) titled "IEEE 802.3 Standard", published in December, 2008 and/or later versions of this standard. Alternatively or additionally, the communication devices may be capable of communicating with each other using an X.25 communications protocol. The X.25 communications protocol may comply or be compatible with a standard promulgated by the International Telecommunication Union-Telecommunication Standardization Sector (ITU-T). Alternatively or additionally, the communication devices may be capable of communicating with each other using a frame relay communications protocol. The frame relay communications protocol may comply or be compatible with a standard promulgated by Consultative Committee for International Telegraph and Telephone (CCITT) and/or the American National Standards Institute (ANSI). Alternatively or additionally, the transceivers may be capable of communicating with each other using an Asynchronous Transfer Mode (ATM) communications protocol. The ATM communications protocol may comply or be compatible with an ATM standard published by the ATM Forum titled "ATM-MPLS Network Interworking 2.0" published August 2001, and/or later versions of this standard. Of course, different and/or after-developed connection-oriented network communication protocols are equally contemplated herein.

Unless specifically stated otherwise as apparent from the foregoing disclosure, it is appreciated that, throughout the foregoing disclosure, discussions using terms such as "processing," "computing," "calculating," "determining," "displaying," or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

One or more components may be referred to herein as "configured to," "configurable to," "operable/operative to," "adapted/adaptable," "able to," "conformable/conformed to," etc. Those skilled in the art will recognize that "configured to" can generally encompass active-state components and/or inactive-state components and/or standby-state components, unless context requires otherwise.

It will be further appreciated that, for convenience and clarity, spatial terms such as "vertical", "horizontal", "up", and "down" may be used herein with respect to the drawings. However, treatment systems can be used in many orientations and positions, and these terms are not intended to be limiting and/or absolute.

Those skilled in the art will recognize that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flow diagrams are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

It is worthy to note that any reference to "one aspect," "an aspect," "an exemplification," "one exemplification," and the like means that a particular feature, structure, or characteristic described in connection with the aspect is included in at least one aspect. Thus, appearances of the phrases "in one aspect," "in an aspect," "in an exemplification," and "in one exemplification" in various places throughout the specification are not necessarily all referring to the same aspect. Furthermore, the particular features, structures or characteristics may be combined in any suitable manner in one or more aspects.

Any patent application, patent, non-patent publication, or other disclosure material referred to in this specification and/or listed in any Application Data Sheet is incorporated by reference herein, to the extent that the incorporated materials is not inconsistent herewith. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

In summary, numerous benefits have been described which result from employing the concepts described herein. The foregoing description of the one or more forms has been presented for purposes of illustration and description. It is not intended to be exhaustive or limiting to the precise form disclosed. Modifications or variations are possible in light of the above teachings. The one or more forms were chosen and described in order to illustrate principles and practical application to thereby enable one of ordinary skill in the art to utilize the various forms and with various modifications as are suited to the particular use contemplated. It is intended that the claims submitted herewith define the overall scope.

What is claimed is:

1. An apparatus for treating an ice skate blade, the ice skate blade comprising a first face, a second face opposing the first face, and a hollow intermediate the first face and the second face, the apparatus comprising:

a rotary brush, comprising:

a hub, wherein a brush axis extends through said hub; and a plurality of bristles extending radially from said hub;

an electric motor drivingly coupled to said rotary brush and operably configured to rotate said bristles about said brush axis; and a receptacle dimensioned to position the ice skate blade relative to said rotary brush such that the ice skate blade is oriented substantially orthogonal to said brush axis and said rotary brush is configured to simultaneously contact the first face, the second face, and the hollow of the ice skate blade.

2. The apparatus of claim 1, further comprising a linear actuator.

3. The apparatus of claim 2, wherein said linear actuator is configured to move said rotary brush relative to the ice skate blade.

4. The apparatus of claim 3, wherein the ice skate blade extends along a blade axis when positioned in said receptacle, and wherein said linear actuator is configured to move said rotary brush along a longitudinal axis that is parallel to the blade axis.

5. The apparatus of claim 1, further comprising an input device and a control circuit configured to:

receive an input signal from said input device; and send an output signal to the electric motor based on the input signal from said input device.

6. The apparatus of claim 5, further comprising a housing configured to enclose said rotary brush and said control circuit.

7. The apparatus of claim 1, wherein said rotary brush comprises an abrasive filament brush comprising flexible bristles.

8. The apparatus of claim 7, wherein said flexible bristles comprise diamond filaments.

9. The apparatus of claim 1, wherein the ice skate blade comprises a first width, and wherein said rotary brush comprises a second width that is greater than the first width.

10. The apparatus of claim 1, wherein said receptacle comprises a longitudinal slot, and wherein at least a portion of the ice skate blade extends through said longitudinal slot.

11. A method for treating an ice skate blade, wherein the ice skate blade comprises a longitudinal axis, the method comprising:

positioning the ice skate blade in a receptacle;

moving a rotary brush along a longitudinal path that is parallel to the longitudinal axis of the ice skate blade, wherein the rotary brush comprises a plurality of radially-extending flexible bristles configured to operably contact the ice skate blade as the rotary brush moves along the longitudinal path, and wherein the rotary brush is configured to rotate about a brush axis that is substantially orthogonal to the longitudinal path; and treating the ice skate blade with a grinding wheel before positioning the ice skate blade in the receptacle.

12. The method of claim 11, wherein the radially-extending flexible bristles comprise diamond filaments configured to hone the ice skate blade.

13. A method for treating an ice skate blade, the method comprising:

positioning the ice skate blade in a receptacle comprising a longitudinal slot, wherein at least a portion of the ice skate blade extends through the longitudinal slot;

moving a rotary brush along a longitudinal path that is parallel to the longitudinal slot, wherein the rotary brush comprises a plurality of radially-extending flexible bristles configured to operably contact the ice skate blade as the rotary brush moves along the longitudinal path; and treating the ice skate blade with a grinding wheel before positioning the ice skate blade in the receptacle.

14. The method of claim 11, wherein the ice skate blade comprises outer lateral sides, and wherein the method further comprises centering the ice skate blade relative to the rotary brush such that the radially-extending flexible bristles contact the outer lateral sides of the blade.

15. A method for sharpening an ice skate blade, the ice skate blade comprising a first face, a second face, and a hollow defined between the first face and the second face, the method comprising:

performing a primary treatment using a grinding wheel;

performing a secondary treatment using an abrasive filament brush comprising flexible bristles, wherein the abrasive filament brush is configured to rotatably contact the first face, the second face, and the hollow of the ice skate blade, and moving the abrasive filament brush along a longitudinal path.

16. The method of claim 15, further comprising actuating an actuator on a housing of the abrasive filament brush to automatically perform the secondary treatment.

17. A method for sharpening an ice skate blade, the ice skate blade comprising a first face, a second face, and a hollow defined between the first face and the second face, the method comprising:

performing a primary treatment using a grinding wheel; and performing a secondary treatment using an abrasive filament brush comprising flexible bristles, wherein the abrasive filament brush is configured to rotatably contact the first face, the second face, and the hollow of the ice skate blade, wherein the secondary treatment comprises:

positioning the ice skate blade in a receptacle; and moving the abrasive filament brush along a longitudinal path and rotating the abrasive filament brush about an axis that is substantially orthogonal to the longitudinal path.

18. The method of claim 17, wherein the abrasive filament brush is configured to rotatably contact the ice skate blade as the abrasive filament brush moves along the longitudinal path.

19. The method of claim 18, further comprising automatically completing the secondary treatment after the abrasive filament brush has moved back and forth along the longitudinal path a preset number of times.

20. An apparatus for applying a secondary treatment to an ice skate blade after a primary grinding treatment is performed on the ice skate blade, wherein the ice skate blade comprises a first face, a second face opposing the first face, and a hollow intermediate the first face and the second face, and wherein the apparatus comprises:

a rotary brush configured to move through at least one back-and-forth pass to treat the ice skate blade, wherein the rotary brush comprises:

a hub, wherein a brush axis extends through said hub; and a plurality of bristles extending radially from said hub;

an electric motor drivingly coupled to said rotary brush and operably configured to rotate said bristles about said brush axis; and a receptacle dimensioned to position the ice skate blade relative to said rotary brush such that the ice skate blade is oriented substantially orthogonal to said brush axis and said rotary brush is configured to contact the first face, the second face, and the hollow of the ice skate blade during a single back-and-forth pass of the rotary brush.

* * * * *